US010042280B2

(12) United States Patent
Hirose et al.

(10) Patent No.: US 10,042,280 B2
(45) Date of Patent: Aug. 7, 2018

(54) IMAGE FORMING APPARATUS AND STORAGE UNIT

(71) Applicant: CANON KABUSHIKI KAISHA, Tokyo (JP)

(72) Inventors: Takafumi Hirose, Utsunomiya (JP); Hajime Sugaya, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/311,497

(22) PCT Filed: Apr. 28, 2015

(86) PCT No.: PCT/JP2015/002289
§ 371 (c)(1),
(2) Date: Nov. 15, 2016

(87) PCT Pub. No.: WO2015/174040
PCT Pub. Date: Nov. 19, 2015

(65) Prior Publication Data

US 2017/0082939 A1 Mar. 23, 2017

(30) Foreign Application Priority Data

May 16, 2014 (JP) ..... 2014-102169

(51) Int. Cl.
*G03G 15/00* (2006.01)
*G03G 15/043* (2006.01)
*B41J 13/10* (2006.01)

(52) U.S. Cl.
CPC ..... *G03G 15/043* (2013.01); *B41J 13/106* (2013.01); *G03G 15/5091* (2013.01); *G03G 15/6538* (2013.01); *G03G 15/6552* (2013.01)

(58) Field of Classification Search
None
See application file for complete search history.

(56) References Cited

U.S. PATENT DOCUMENTS 3,845,949 A 11/1974 Acquaviva
5,358,238 A * 10/1994 Mandel ..... B65H 31/24 101/2

(Continued)

FOREIGN PATENT DOCUMENTS

JP H07125909 A 5/1995
JP 2004-326038 A 11/2004

(Continued)

*Primary Examiner* — Anthony Nguyen
(74) *Attorney, Agent, or Firm* — Canon U.S.A., Inc. IP Division

(57) ABSTRACT

An image forming apparatus includes an apparatus body having an opening, an image forming unit, a storage portions, a moving unit, and a sensing unit. The storage portions store, inside the apparatus body, a sheet having an image. The moving unit can move the sheet stored in each storage portion and stop the sheet in an exposure state where the sheet is exposed outside the apparatus body through the opening. The moving unit moves a first stored sheet and stops the first sheet in the exposure state. If the sensing unit enters a state in which the first sheet is not sensed from a state in which the first sheet is sensed, the moving unit moves a second stored sheet and stops the second sheet in the exposure state where the second sheet is exposed outside the apparatus body through the opening through which the first sheet is exposed.

9 Claims, 13 Drawing Sheets

(56) References Cited

U.S. PATENT DOCUMENTS

| | | | | | |
|---|---|---|---|---|---|
| 5,839,048 | A * | 11/1998 | Kato | B42C 1/125 | 399/407 |
| 5,881,351 | A * | 3/1999 | Shimotoso | G03G 15/60 | 399/377 |
| 6,112,047 | A * | 8/2000 | Kato | B65H 29/00 | 271/279 |
| 2002/0081134 | A1* | 6/2002 | Miyamoto | B65H 31/22 | 399/405 |
| 2006/0193668 | A1* | 8/2006 | Akiyama | G03G 15/6552 | 399/405 |
| 2009/0160123 | A1* | 6/2009 | Jones | B65H 31/3081 | 271/213 |
| 2010/0221032 | A1* | 9/2010 | Ishio | G03G 15/6552 | 399/82 |
| 2013/0063793 | A1* | 3/2013 | Suzuki | G03G 21/00 | 358/498 |
| 2014/0151955 | A1* | 6/2014 | Yoshida | B65H 29/125 | 271/184 |

FOREIGN PATENT DOCUMENTS

| | | | |
|---|---|---|---|
| JP | 2013-107763 | A | 6/2013 |
| WO | 2013-157192 | A1 | 10/2013 |

* cited by examiner

IMAGE FORMING APPARATUS AND STORAGE UNIT

CROSS REFERENCE TO RELATED APPLICATIONS

The present application is a national phase application of application number PCT/JP2015/002289, filed on Apr. 28, 2015, which claims the benefit of Japanese Patent Application No. 2014-102169, filed May 16, 2014, all of which are hereby incorporated by reference herein in their entirety.

BACKGROUND OF THE INVENTION

Technical Field

The present invention relates to an image forming apparatus including a storage portion that temporarily stores a sheet having an image formed thereon and a storage unit.

Background Art

In general, some image forming apparatuses, such as a copying machines and printers, include a storage portion that temporarily stores, in the apparatus, a sheet having an image formed thereon.

PTL 1 describes an image forming apparatus incorporating a plurality of storage portions each temporarily stores a sheet having an image formed thereon in addition to an output tray that is disposed on an upper surface of the apparatus body and that is shared by a plurality of users. The image forming apparatus delivers a sheet to any one of the storage portions assigned to each of the users. When the user picks up the sheet from the storage portion, user authentication is performed using, for example, an ID card. To perform user authentication, a user causes an ID card reader unit mounted in the image forming apparatus to read their ID card. If the user authentication is successful, the sheet to be output from the image forming apparatus in response to a user instruction is output to the outside. In this manner, the user can pick up only their own sheet having an image formed thereon.

CITATION LIST

Patent Literature

PTL 1: Japanese Patent Laid-Open No. 7-125909

SUMMARY OF INVENTION

Technical Problem

A configuration in which as described in PTL 1, a storage portion is disposed inside an image forming apparatus has a limitation on the capacity of the storage portion to store sheets due to an available space in the image forming apparatus. Accordingly, if a user instructs to print a number of sheets that exceeds the capacity of one storage portion, the printed sheets need to be placed in a plurality of the storage portions. According to the image forming apparatus described in PTL 1, to pick up the sheets stored in the plurality of storage portions of the image forming apparatus, the user needs to input a sheet output instruction a plurality of times. Accordingly, if sheets that the user wants to pick up are stored in a plurality of storage portions, the number of sheet output instructions that the user needs to input increases, which requires cumbersome procedures for the user.

Solution to Problem

The present invention provides an image forming apparatus and a storage unit that allow a user to pick up sheets stored in a plurality of storage portions with a minimum operation.

According to an aspect of the present invention, an image forming apparatus includes an apparatus body having an opening formed therein, an image forming unit configured to form an image on a sheet, a plurality of storage portions configured to store, inside the apparatus body, a sheet having an image formed thereon by the image forming unit, a sheet moving unit configured to move the sheet stored in each of the plurality of storage portions and to stop the sheet in an exposure state where a part of the sheet is exposed outside the apparatus body through the opening, a control unit configured to control the sheet moving unit, and a sensing unit configured to sense a sheet that is in the exposure state, wherein the control unit controls the sheet moving unit to move a first sheet stored in a first storage portion and to stop the first sheet in the exposure state, and wherein, if the sensing unit enters a state in which the first sheet is not sensed by the sensing unit from a state in which the first sheet is sensed by the sensing unit, the control unit controls the sheet moving unit to move a second sheet stored in a second storage portion other than the first storage portion, and to stop the second sheet in the exposure state where a part of the second sheet is exposed outside the apparatus body through the opening through which the first sheet is exposed.

Further features of the present invention will become apparent from the following description of exemplary embodiments with reference to the attached drawings.

DESCRIPTION OF EMBODIMENTS

First Embodiment

Embodiments of the present invention are described in detail below with reference to the accompanying drawings.

Configuration of Image Forming Apparatus

Figure 1:
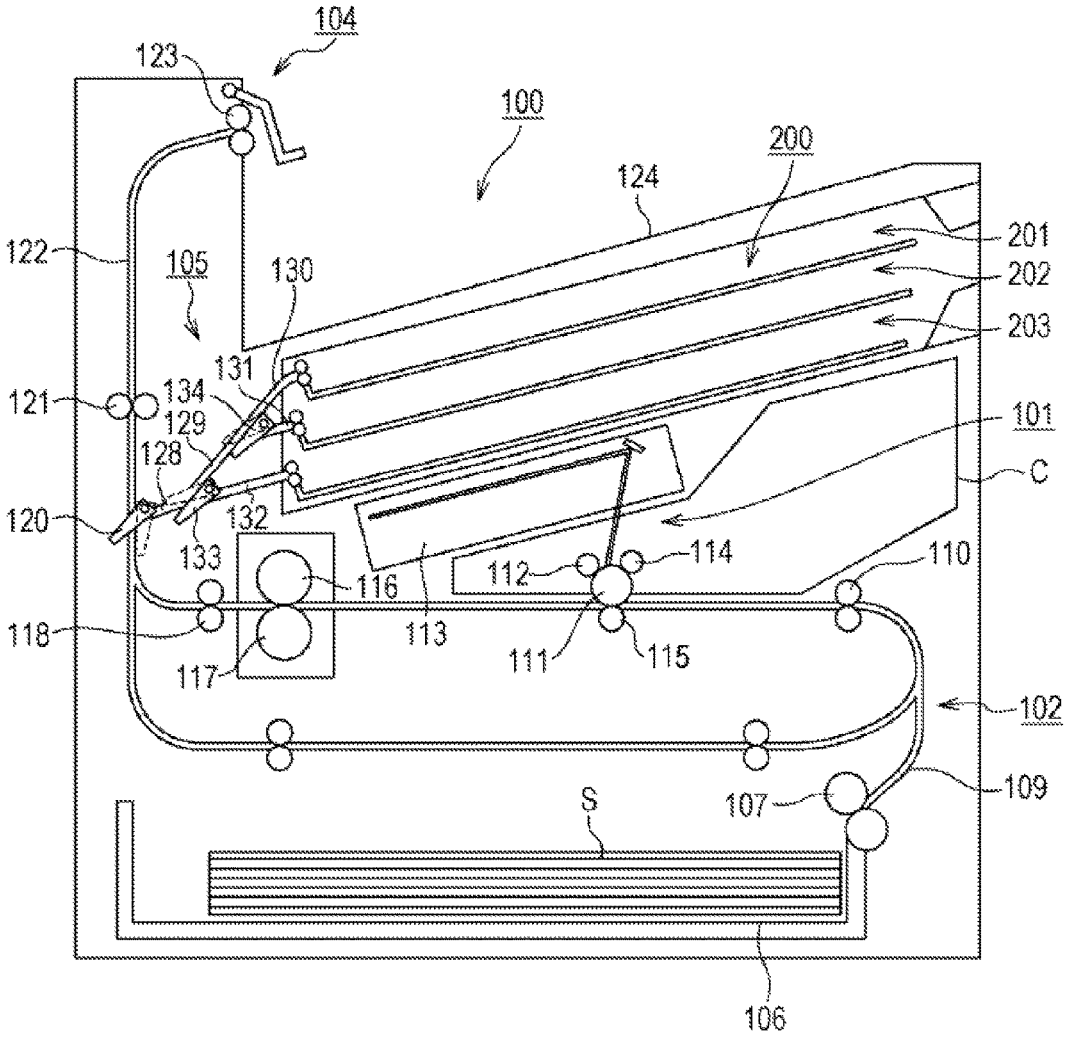
FIG. 1 illustrates the configuration of an image forming apparatus according to an embodiment of the present invention.

FIG. 1 illustrates the configuration of an image forming apparatus including storage portions according to a first embodiment of the present invention. Note that according to the present embodiment, a laser beam printer is employed as an example of the image forming apparatus.

An image forming apparatus 100 includes an image forming unit 101, a feed unit 102 that supplies a sheet S to the image forming unit 101, and an output unit 104 that outputs the sheet S having an image formed thereon by the image forming unit 101. As used herein, the term "sheet" refers to a medium on which the image forming unit 101 forms an image. Examples of the sheet include a paper sheet, an OHP sheet, and cloth. In addition, the image forming apparatus 100 includes a storage unit 200 above the image forming unit 101. The storage unit 200 includes a plurality of storage portions 201 to 203 each temporarily stores the sheet S having an image formed thereon. Still furthermore, the image forming apparatus 100 includes a conveyance unit 105 that conveys a sheet S having an image formed thereon to the storage unit 200.

The image forming unit 101 includes a photosensitive drum 111 that rotates in a clockwise direction (a CW direction) illustrated in FIG. 1, a charging roller 112 that charges a surface of the photosensitive drum 111, and an exposure device 113 that emits a light beam to the photosensitive drum 111 and forms an electrostatic latent image on the photosensitive drum 111. In addition, the image forming unit 101 includes a development device 114 that deposits toner onto the electrostatic latent image and forms a toner image on the photosensitive drum 111 and a transfer roller 115 that transfers the toner image to a sheet S that is conveyed. In addition, the image forming unit 101 includes a fixing roller 116, a pressure roller 117 that is in contact with the fixing roller 116, and a fixing output roller 118. The image forming unit 101 fixes, to the sheet S, the toner image transferred to the sheet S. Through such an electrophotographic image forming process, the image forming unit 101 forms a toner image on the sheet S. At that time, in the image forming apparatus 100 according to the present embodiment, the photosensitive drum 111, the charging roller 112, the development device 114, and a toner container (not illustrated) that contains toner are integrated into a cartridge C, which is removable from the body of the image forming apparatus 100. If the toner runs out, the user can replace the cartridge C with a new one. In this manner, the user can conduct maintenance of the image forming apparatus 100 by themselves without calling a service person. Note that the present invention is not limited to such an image forming apparatus 100 of a cartridge type. For example, the present invention is applicable to a configuration in which members, such as the photosensitive drum 111, the charging roller 112, and the development device 114, are attached to the image forming apparatus 100 (i.e., the image forming apparatus 100 of a non-removable parts type).

The feed unit 102 includes a supply cassette 106 containing a plurality of the sheets S that are used to form an image and that are stacked therein, a feed roller 107, a conveyance guide 109, and a registration roller 110.

The output unit 104 includes a first switching member 120, a conveyance roller 121, an output guide 122, an output roller 123, and an output tray 124. The first switching member 120 can switch the sheet S having an image formed thereon between a position at which the sheet S is led to the storage unit 200 (refer to a solid line in FIG. 1) and a position at which the sheet S is led to the output tray 124 (refer to a dashed line in FIG. 1) using an actuator (not illustrated). The output tray 124 is disposed on the upper surface of the image forming apparatus 100. The output tray 124 can be shared by a plurality of users. The output tray 124 receives the sheet S output with a surface that has an image formed thereon (a front surface) facing downward (face down).

The conveyance unit 105 includes a second switching member 133 and a third switching member 134 each switching the destination of the sheet S and conveyance guides 128 to 132 that lead the sheet S toward the storage portions 201 to 203. As illustrated in FIG. 1, the position of each of the second switching member 133 and the third switching member 134 can be switched between a position shown as a solid line and a position shown as a dashed line by an actuator (not illustrated). For example, if the sheet S is conveyed to the storage portion 201, the second switching member 133 and the third switching member 134 are located at the positions shown as the solid lines in FIG. 1. The sheet S passes through the conveyance guide 128 and, thereafter, passes through the conveyance guides 129 and 130. Thus, the sheet S is conveyed to the storage portion 201. In contrast, if the sheet S is conveyed to the storage portion 202, only the position of the third switching member 134 is switched to a position shown as a dashed line. In this case, the sheet S passes through the conveyance guides 128, 129, and 131. Thus, the sheet S is conveyed to the storage portion 202. Note that like the output tray 124, the sheet S is output to each of the storage portions 201 to 203 face down.

Configuration of Storage Unit

Figure 2:
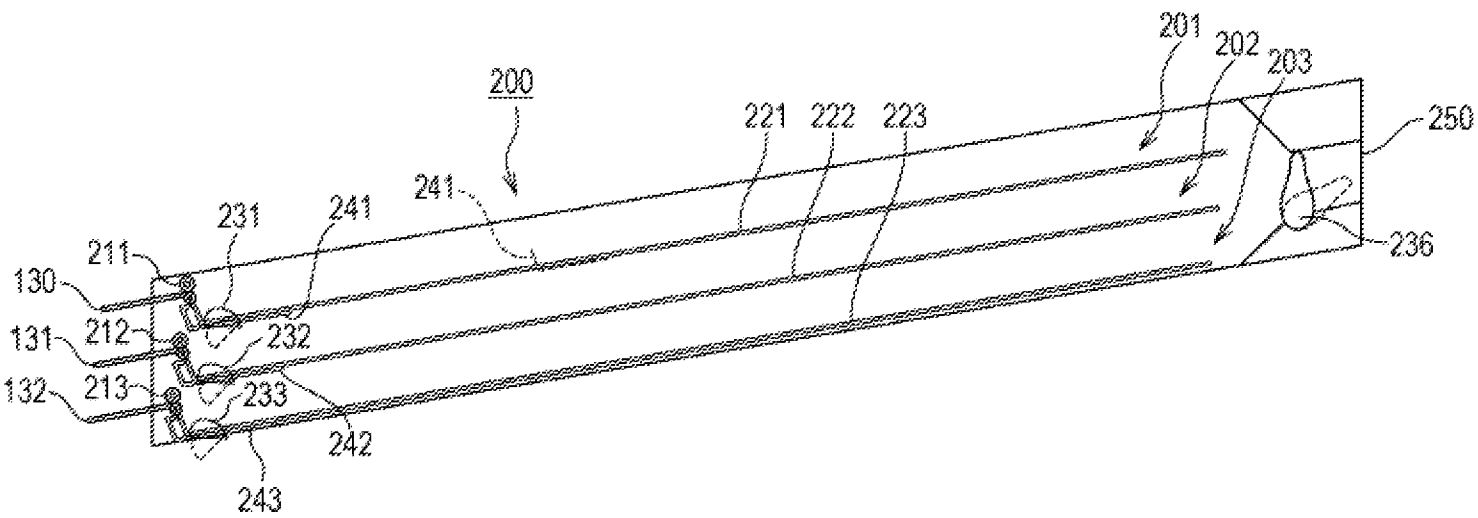
FIG. 2 illustrates the configuration of a storage unit according to the embodiment of the present invention.

FIG. 2 illustrates the configuration of the storage unit 200. According to the present embodiment, the storage unit 200 has the storage portions 201 to 203 stacked in the vertical direction. The storage portions 201 to 203 have the same structure. Accordingly, only the structure of the storage portion 201 is described below.

The storage portion 201 includes a conveyance roller 211 that conveys the sheet S, a loading tray 221 that loads the sheet S thereon and temporarily stores the sheet S, and a sheet sensor 231 that detects whether the sheet S is stored in the loading tray 221. In addition, the storage portion 201 includes a sheet moving unit 241 that applies a pressure to the trailing edge of the stored sheet S (the edge of the sheet S on the upstream side in the conveyance direction) to expose part of the sheet S outside the image forming apparatus 100. The sheet moving unit 241 moves the sheet S to a position at which the user can pick up the sheet S, that is, until the leading edge of the sheet S (the edge of the sheet S on the downstream side in the conveyance direction) passes through an opening 250. In this manner, the sheet moving unit 241 can expose part of the sheet S outside of the image forming apparatus 100 by a predetermined length. Note that according to the present embodiment, the predetermined length of the part of the sheet S to be exposed outside the image forming apparatus 100 is set to 30 mm. The predetermined length is only an example. Any length that allows the user to grip the sheet S exposed and that prevents the sheet S from excessive bending can be set.

In addition, the length of the loading tray 221 is determined so as to prevent the leading edge of the sheet S from being exposed outside through the opening 250 even when the sheet S having the largest size among the sizes of the sheet S that can be stored in the storage portion 201 is loaded onto the storage portion 201. If the sheet S is loaded onto the loading tray 221 and, thus, the sensor 231 is tilted to a position shown as a dashed line, the sensor 231 is turned on. Thereafter, if the sheet S is moved by the sheet moving unit 241 and, thus, the sensor 231 returns to a position shown as a solid line, the sensor 231 is turned off. In addition, if the leading edge of the moved sheet S tilts an opening sensor 236 disposed in the vicinity of the opening 250 to a position indicated by a dashed line, the sensor 236 is turned on. If the sheet S exposed outside the image forming apparatus 100 is removed and, thus, the sensor 236 returns to the position shown as a solid line, the sensor 236 is turned off. When the sheets S are sequentially conveyed to the storage portion 201, the sheet moving unit 241 is located at a loading position shown as a solid line. In contrast, to expose the stored sheet S to the outside, the sheet moving unit 241 can move toward the opening 250 along the conveyance direction of the sheet S and reach the exposed position shown as a dashed line. The exposed position, that is, a moving distance of the sheet moving unit 241 is determined in accordance with a length of the sheet S to be exposed and the size of the sheet S in the conveyance direction.

Figure 3:
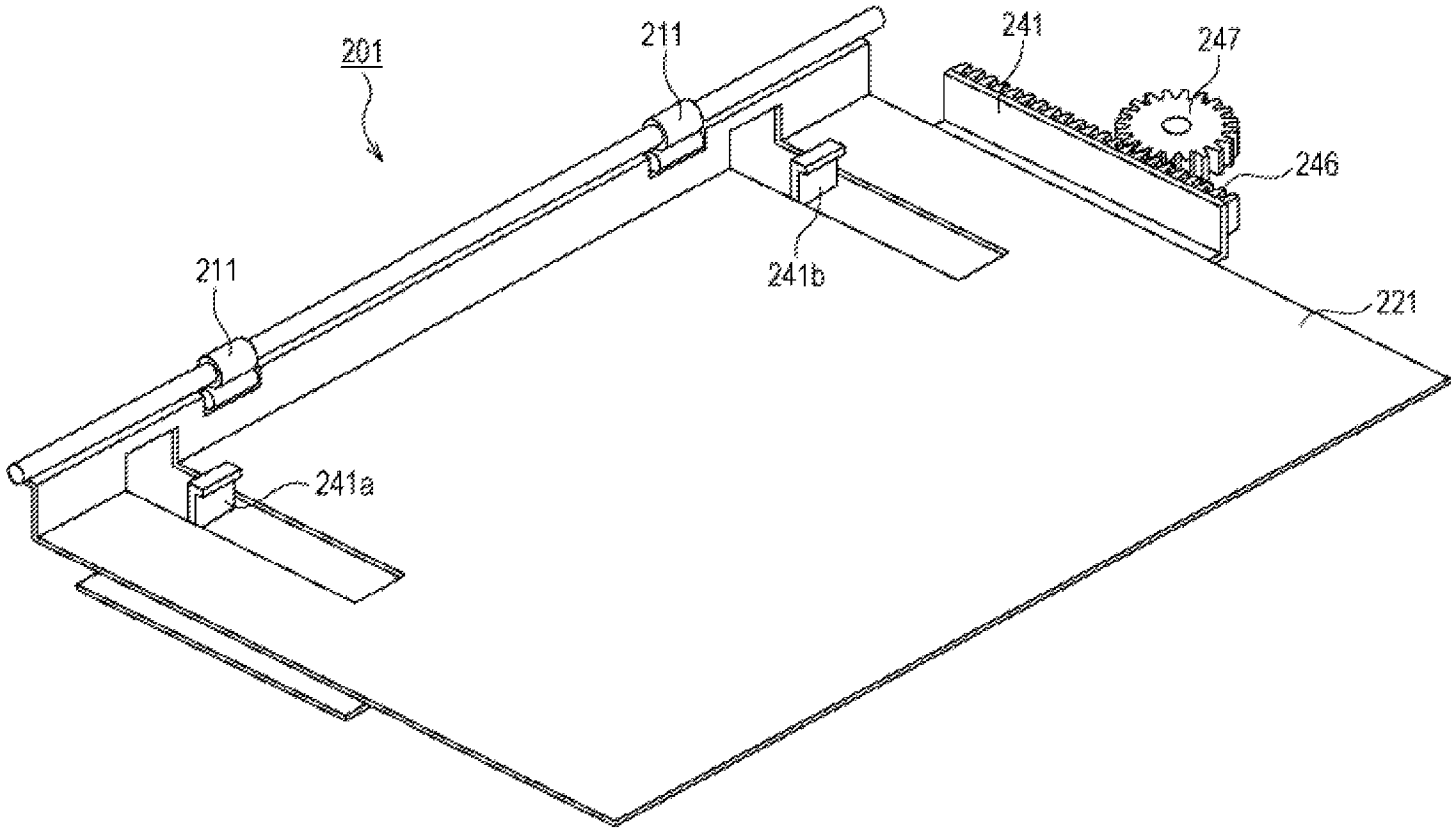
FIG. 3 is a perspective view of a storage portion according to the embodiment of the present invention.

FIG. 3 is a perspective view of the storage portion 201. As illustrated in FIG. 3, the sheet moving unit 241 is located between the loading position and the exposed position. The sheet moving unit 241 has two sheet trailing edge pressing units 241*a* and 241*b* disposed in the width direction of the sheet S. In addition, the sheet moving unit 241 has a rack 246 integrated thereinto. The rack 246 is meshed with a pinion 247. The pinion 247 is connected to an actuator serving as a drive unit (not illustrated in FIG. 3). The actuator rotates in the positive direction or the opposite direction so that the sheet moving unit 241 is movable between the loading position and the exposed position in a reciprocal manner.

Block Diagram of Control Unit and Functional Configuration

Figure 4:
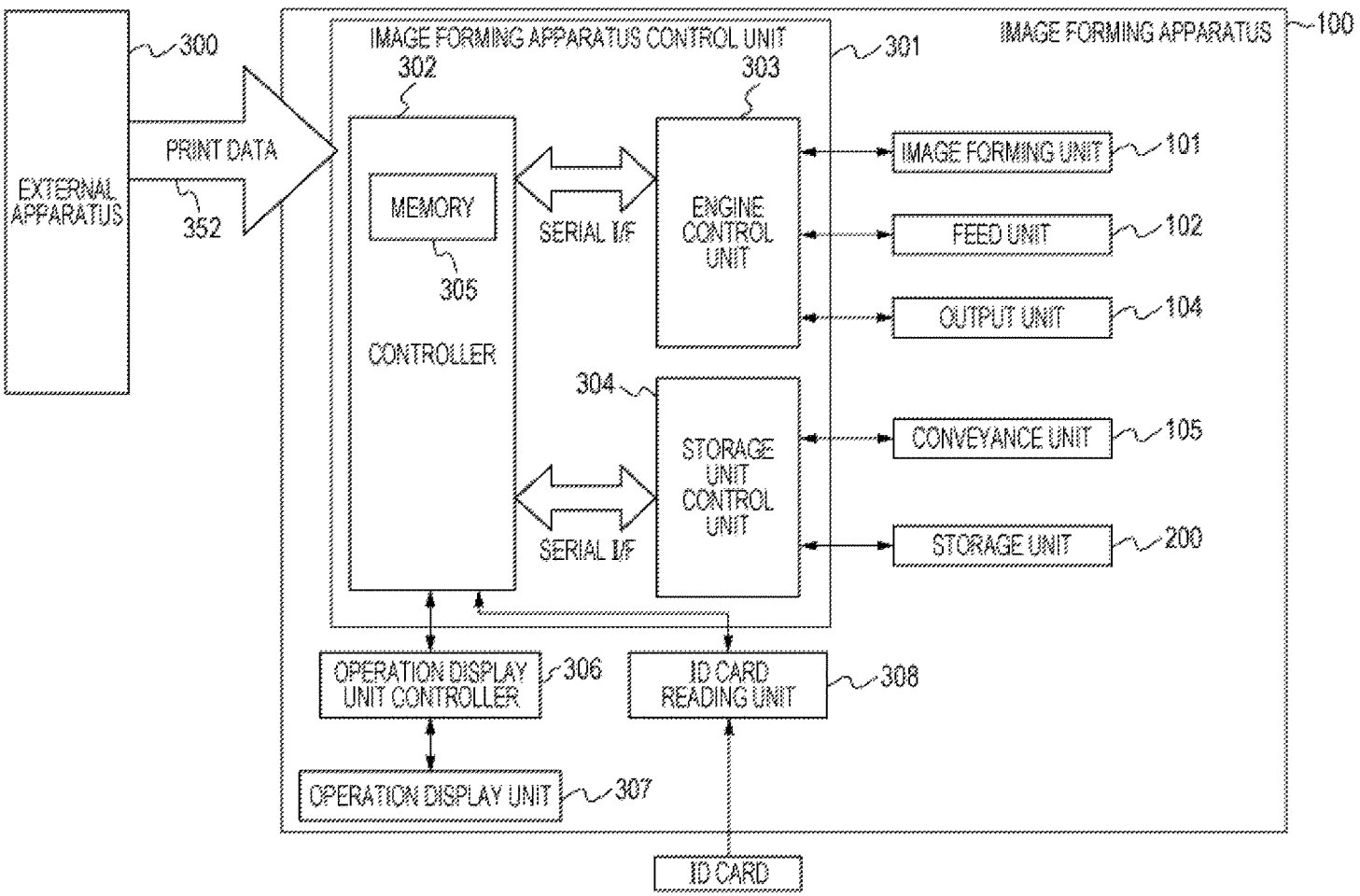
FIG. 4 is a block diagram of a control unit of the image forming apparatus and the functional configuration according to the present embodiment of the invention.

FIG. 4 is a block diagram of a control unit and the functional configuration according to the present embodiment. The image forming apparatus 100 includes an image forming apparatus control unit 301 serving as a control unit. The control unit 301 includes a controller 302, an engine control unit 303, and a storage unit control unit 304.

The controller 302 communicates with an external apparatus 300, such as a host computer, to receive print data 352. Thereafter, the controller 302 stores the receive print data 352 in a memory 305, such as a random access memory (RAM). The controller 302 analyzes the print data 352 stored in the memory 305 and generates a print condition. The print condition is information indicating, for example, the number of the sheets S supplied, the destination of the sheet S having an image formed thereon (the output tray 124 or the storage unit 200), and the image density of an image to be printed. In addition, the controller 302 sends, to the engine control unit 303, the print condition generated from the print data 352 using a serial interface (I/F). The engine control unit 303 controls mechanisms in accordance with the print condition received from the controller 302. More specifically, the engine control unit 303 controls the image forming unit 101 to form an image on the sheet S and controls the feed unit 102 and the output unit 104 to feed and output the sheet S.

In addition, the controller 302 analyzes the print data 352 stored in the memory 305 and generates storage conditions and output conditions of the storage portions 201 to 203. Thereafter, the controller 302 sends, to the control unit 304, the storage conditions and output conditions generated from the print data 352 using a serial interface (I/F). The storage condition is information indicating, for example, the destination of the sheet S having an image formed thereon and the number of the sheets S that can be stored. As used herein, the term "output condition" refers to information indicating, for example, a moving distances of the sheet moving unit 241 and moving distances of sheet moving units 242 and 243 required for exposing the sheet S to the outside through the opening 250. The control unit 304 controls mechanisms in accordance with the storage conditions and output conditions received from the controller 302. More specifically, the control unit 304 controls the conveyance unit 105 to convey the sheet S having an image formed thereon to each of the storage portions 201 to 203 and controls the storage unit 200 including the sheet moving unit 241 to move the sheet S stored in each of the storage portions 201 to 203 to the opening 250. In addition, an operation display unit controller 306 performs control so that a variety of settings and an output instruction input by the user through an operation display unit 307 are sent to the controller 302.

Details of Storage Unit Control Unit

Figure 5:
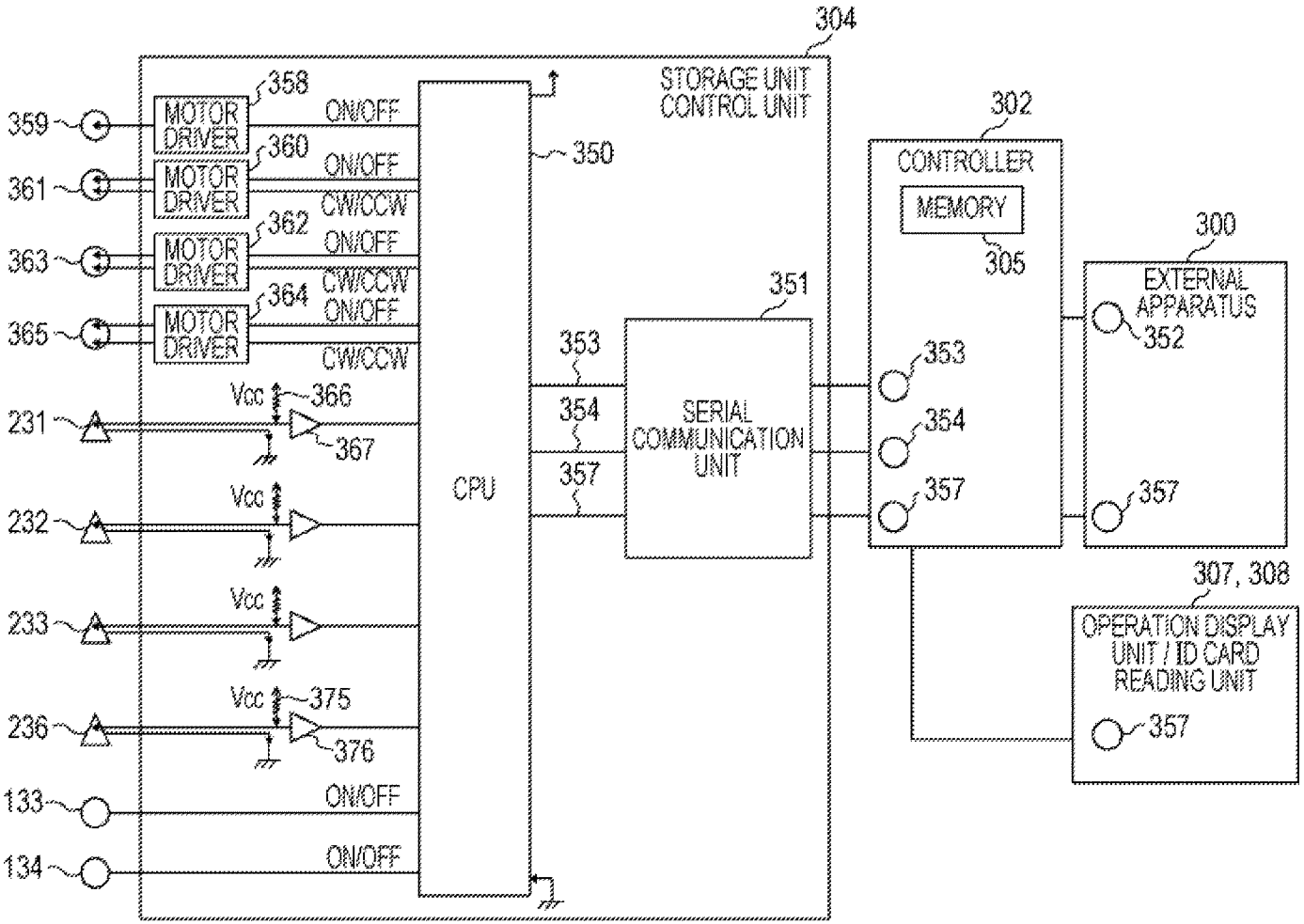
FIG. 5 illustrates a storage unit control unit according to the present embodiment of the invention in detail.

FIG. 5 illustrates the control unit 304 according to the present embodiment in detail. The control unit 304 includes a central processing unit (CPU) 350. The control unit 304 communicates with the controller 302 via a serial communication unit 351. The serial communication unit 351 connects the CPU 350 to the controller 302 using a plurality of signal lines. According to the present embodiment, the serial communication unit 351 includes three signal lines to send a delivery notice signal 353, a storage destination signal 354, and an output instruction signal 357.

The control performed to store the sheet S in the storage unit 200 is described below. Upon receiving the print data 352 via the external apparatus 300, the controller 302 temporarily stores the print data 352 in the memory 305. Thereafter, the controller 302 analyzes the stored print data 352 and sends the delivery notice signal 353 and the storage destination signal 354 to the CPU 350 via the serial communication unit 351. The CPU 350 controls actuators described below on the basis of the sent signals to convey the sheet S having an image formed thereon to one of the storage portions 201 to 203.

The control performed to expose the sheet S outside the storage unit 200 is described below. If the user inputs, to the external apparatus 300 or the operation display unit 307, an instruction to output the sheet S stored in the storage portion, the output instruction signal 357 is sent to the controller 302. The controller 302 selects one of the storage portions from which the sheet S is to be output and sends the output instruction signal 357 to the CPU 350 via the serial communication unit 351. Thus, the controller 302 instructs the CPU 350 to output the sheet S from a corresponding storage portion. The CPU 350 controls the actuators (described below) so as to expose the sheet S stored in the specified storage portion to the outside of the image forming apparatus through the opening 250.

The actuators connected to the CPU 350 are described below.

The CPU 350 has an output terminal connected to a motor driver 358. The motor driver 358 drives a conveyance motor 359. Rotation of the conveyance motor 359 rotates the conveyance roller 211 and conveyance rollers 212 and 213. Thus, the sheet S is conveyed to one of the storage portions 201 to 203.

The output terminal of the CPU 350 is also connected to a motor driver 360. The motor driver 360 drives an output motor 361. If the output motor 361 is rotated in a clockwise direction (a CW direction), the sheet moving unit 241 of the storage portion 201 moves toward the opening 250. However, if the output motor 361 is rotated in a counterclockwise direction (a CCW direction), the sheet moving unit 241 of the storage portion 201 moves in a direction away from the opening 250. Similarly, the output terminal of the CPU 350 is connected to motor drivers 362 and 364, which drive output motors 363 and 365, respectively. The motor 363 controls the sheet moving unit 242 of the storage portion 202, and the motor 365 controls the sheet moving unit 243 of the storage portion 203.

The sensor 231 inputs, to the CPU 350, information as to whether the sheet S is stored in the storage portion 201 via a buffer 367 using a pull-up resistor 366. Similarly, a sheet sensor 232 inputs, to the CPU 350, information as to whether the sheet S is stored in the storage portion 202. Similarly, a sheet sensor 233 inputs, to the CPU 350, information as to whether the sheet S is stored in the storage portion 203.

The sensor 236 inputs, to the CPU 350, information as to whether the sheet S is exposed outside the image forming apparatus 100 through the opening 250 via a buffer 376 using a pull-up resistor 375.

The CPU 350 has an output terminal connected to an actuator (not illustrated) that performs a switching operation on the second switching member 133. If the actuator is turned on, the second switching member 133 is switched so that the sheet S is conveyed toward the conveyance guide 129. However, if the actuator is turned off, the second switching member 133 is switched so that the sheet S is conveyed toward the conveyance guide 132. Similarly, the CPU 350 has an output terminal connected to an actuator (not illustrated) that performs a switching operation on the third switching member 134. If the actuator is turned on, the third switching member 134 is switched so that the sheet S is conveyed toward the conveyance guide 130. However, if the actuator is turned off, the third switching member 134 is switched so that the sheet S is conveyed toward the conveyance guide 131. The CPU 350 performs switching operations on the second switching member 133 and the third switching member 134 on the basis of the storage destination signal 354 sent from the controller 302.

Description of Operation Performed by Storage Unit

Figure 6:
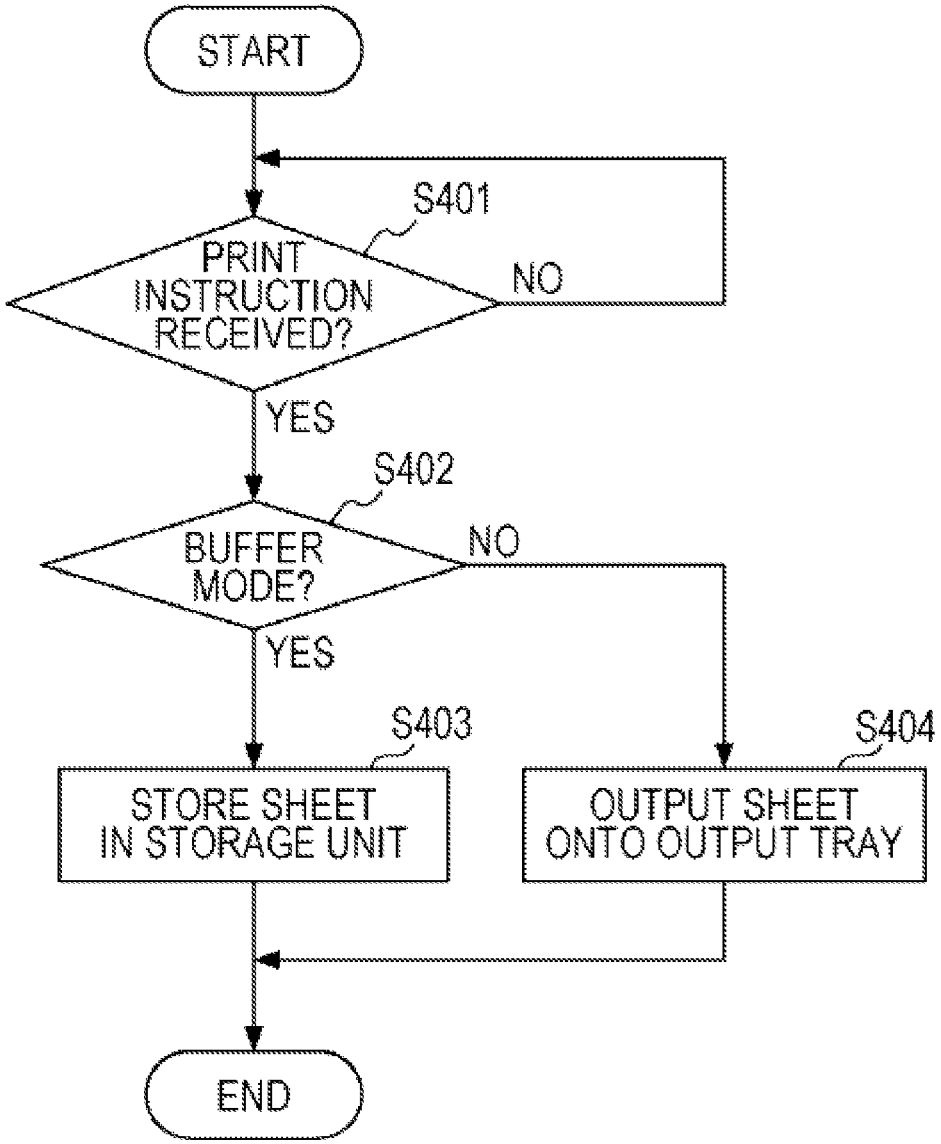
FIG. 6 is a flowchart of a process performed when a sheet is printed according to the present embodiment of the invention.

In the above-described image forming apparatus, the user can select one of a buffer mode and a normal mode using the external apparatus 300 or the operation display unit 307. In the buffer mode, the sheet S is temporarily stored in the storage unit 200. In the normal mode, the sheet S is output to the output tray 124. The mode that is selected is stored in the memory 305. A flowchart of the process performed when the user instructs printing of the sheet S is illustrated in FIG. 6. Note that the control based on such a flowchart is performed by, for example, the controller 302 illustrated in FIG. 4 on the basis of a program stored in the memory 305.

If the user instructs printing of the sheet S via the external apparatus 300, the print data 352 is sent to the controller 302 (S401). Upon receipt of the print data 352, the controller 302 refers to information stored in the memory 305 and determines whether the buffer mode is selected (S402). If the buffer mode is selected, the controller 302 instructs the storage unit 200 to temporarily store the sheet S (S403). However, if the normal mode is selected, the controller 302 instructs the output tray 124 to output the sheet S (S404). Thereafter, the processing of the flowchart is completed. Note that in the flowchart illustrated in FIG. 6, it is assumed that the user selects one of the modes in advance. However, the present invention is not limited thereto. For example, each time the user instructs printing, the user may select one of the modes in which the sheet S is output.

According to the present embodiment, when the sheet S is stored in the storage unit 200, the sheet S is delivered to a storage portion assigned to a job number of the sheet S. In addition, when the sheet S is exposed outside the storage unit 200, the sheet S of the user who input an output instruction of the sheet S is exposed outside the image forming apparatus 100 through the opening 250. By inputting a predetermined password into the external apparatus 300 or the operation display unit 307, the user can send an output instruction. Alternatively, by causing an ID card reading unit 308 to read their own ID card and perform user authentication, the user can send an output instruction. As described above, according to the present embodiment, the storage portions 201 to 203 includes dedicated actuators that drive the sheet moving units 241 to 243, respectively. Accordingly, even when a plurality of storage portions contain sheets S for the same user, the user can pick up the sheets S in one go by driving the corresponding actuators. Note that the information regarding, for example, the job numbers and the user who has instructed printing of the sheet S is stored in the memory 305 provided in the controller 302. In response to the user instruction to output the sheet S, the controller 302 refers to the information in the memory 305 to identify the sheet S to be output and instructs the storage unit 200 to output the sheet S.

Figure 7:
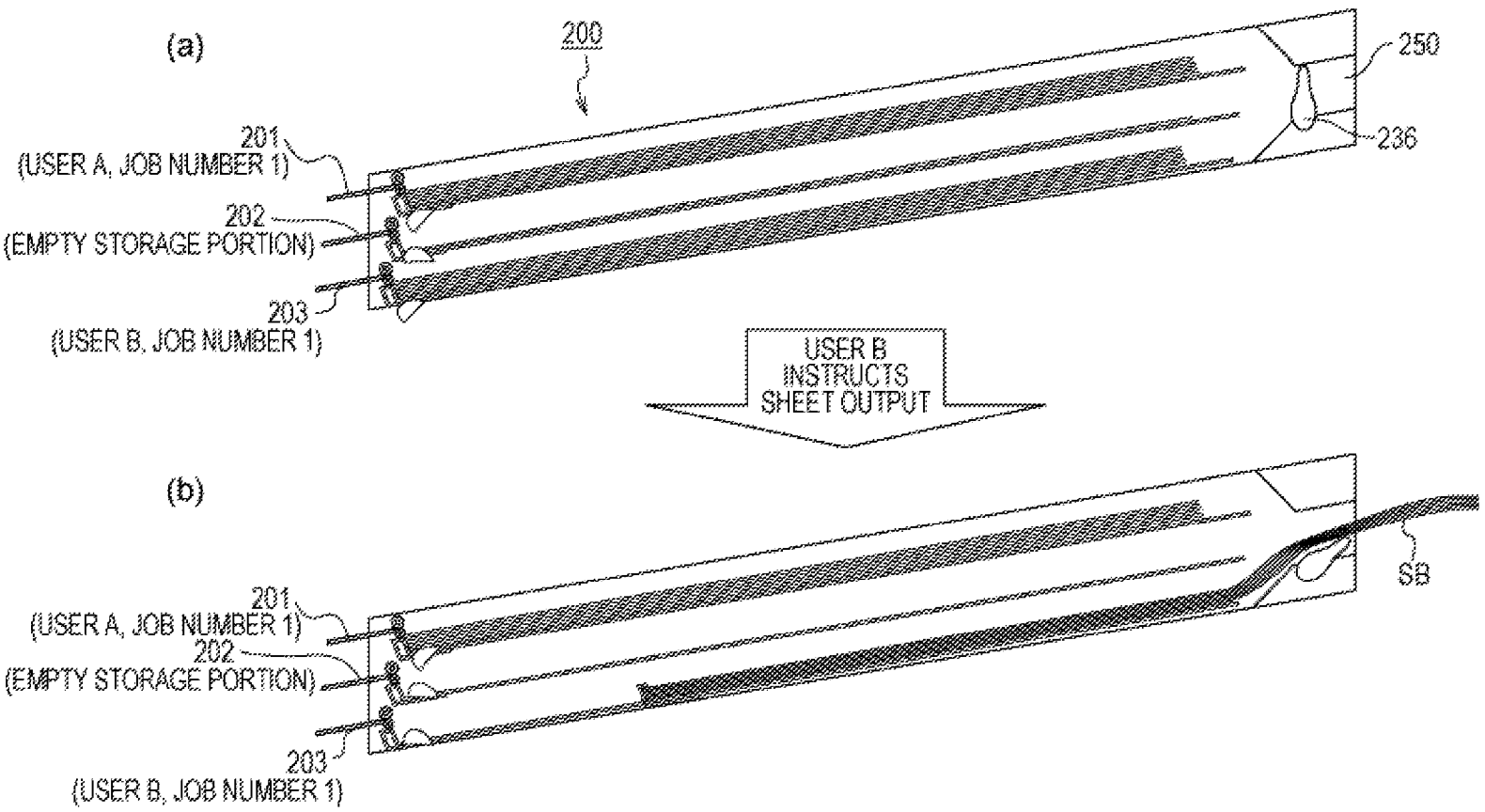
FIG. 7 illustrates the storage unit when a sheet is exposed according to the present embodiment of the invention.

FIG. 7 illustrates an example of the operation performed by the storage unit 200. In a section (a) of FIG. 7, the storage portion 201 stores the sheets S of a user A, and the storage portion 203 stores the sheets S of a user B. The storage portion 202 stores no sheet S. In a section (b) of FIG. 7, if an output instruction of the sheet S of the user B is input, the sheet moving unit 243 of the storage portion 203 moves toward the opening 250 no that a stack of sheets SB is exposed to the outside through the opening 250. A state in which part of a sheet remains inside the storage portion and the other part of the sheet is exposed to the outside through the opening 250 is defined as an exposure state.

Figure 8:
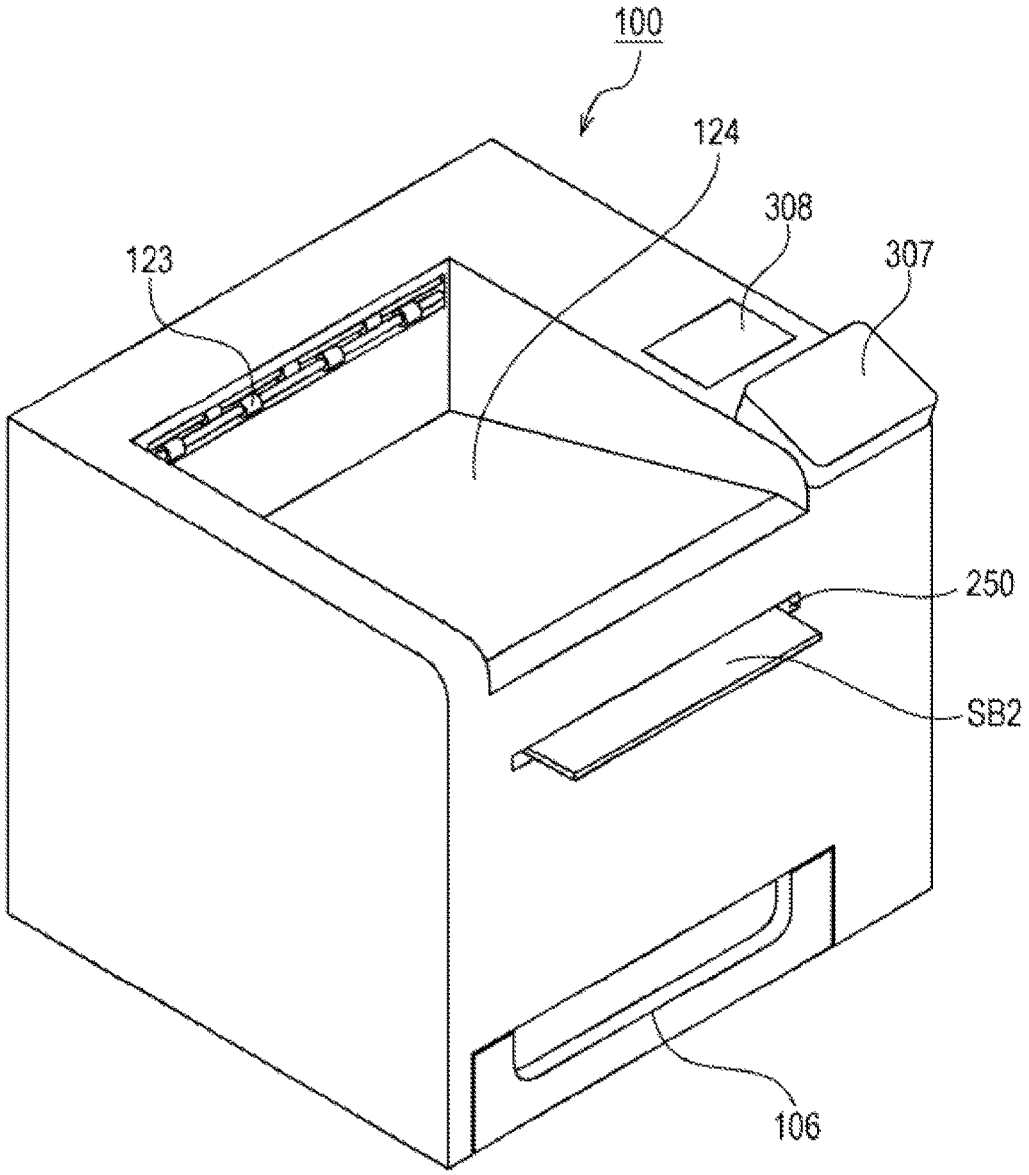
FIG. 8 is a perspective view of the image forming apparatus when sheets are exposed according to the present embodiment of the invention.

FIG. 8 is a perspective view of the image forming apparatus 100 in an exposure state. A leading edge SB2 of the stack of sheets SB is exposed outside the container 203 through the opening 250. By griping the leading edge SB2 exposed outside the image forming apparatus 100 and pulling out the stack of sheets SB, the user can receive the stack of sheets SB.

In addition, if the user inputs an instruction to store a number of sheets S that is greater than the number of sheets that can be contained in one storage portion, some of the sheets S are delivered to another storage portion although the sheets S have the same job number. For example, in the section (a) of FIG. 7, the sheets S of the user B having a job number of "1" are stored in the storage portion 203. If the number of sheets having a job number of "1" is greater than the upper limit of the number of sheets that can be contained in the storage portion 203, some of the sheet S having a job number of "1" are delivered to the storage portion 202. Note that at that time, other sheets S are not stored in the storage portion 202. Example of other sheets include sheets having a different job number and sheets of a different user.

Note that the storage unit 200 is enclosed except for a conveyance port (not illustrated) for conveying the sheet S and the opening 250 for exposing the stored sheet S to the outside. In addition, a member that encloses the storage unit 200 is formed of an opaque material. Accordingly, when the sheet S is stored in each of the storage portions 201 to 203, the user cannot see information printed on the sheet S. In this manner, the user can keep the information printed on the sheet S from prying eyes of another person and, thus, the confidentiality of the information can be increased.

To increase the confidentiality of information, some image forming apparatuses start forming an image after user authentication is performed using, for example, an ID card. However, unlike such image forming apparatuses, the image forming apparatus 100 according to the present embodiment only needs to expose the sheets S having an image formed thereon outside the storage portions 201 to 203. Accordingly, immediately after performing a user authentication operation, the user can pick up the sheets S without waiting for an image to be formed.

In addition, if the user instructs the image forming apparatus 100 to output the sheet S, the user can pick up only their own sheet S. In this manner, the user need not find their own sheet S in the output tray 124 that stores user's sheet and sheets of other users.

Description of Operation to Expose Sheets outside Plurality of Storage Portions

Figure 9:
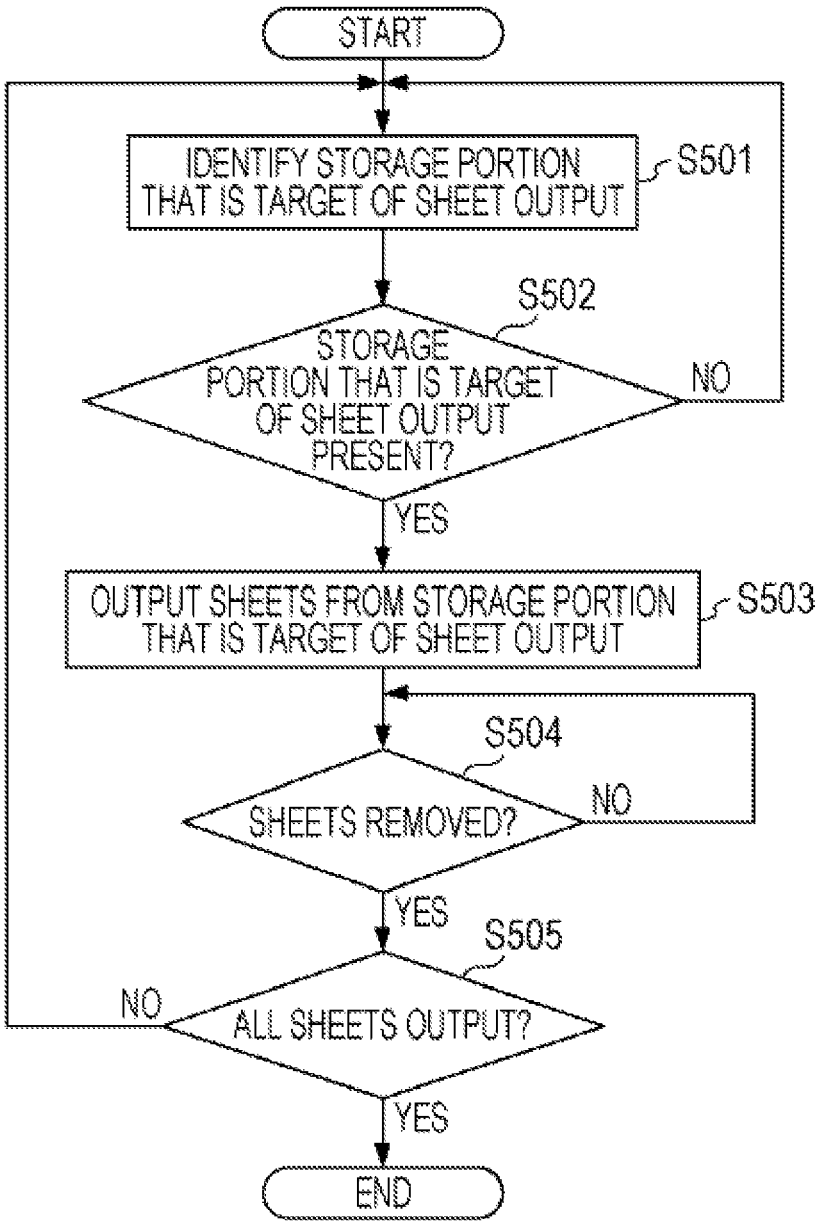
FIG. 9 is a flowchart of a first embodiment of the present invention.

An operation to expose sheets outside a plurality of storage portions is described below. According to the present embodiment, description is made with reference to control performed when a user instructs to form images of a plurality of jobs and, after all the sheets S are stored, instructs to output the stored sheets S. The flowchart of the present embodiment is illustrated in FIG. 9. Note that the control based on the flowchart is performed by, for example, the controller 302 illustrated in FIG. 4 using a program stored in the memory 305.

The flowchart illustrated in FIG. 9 relates to control performed mainly when the sheets S are output from the storage unit 200. If the user inputs, to the external apparatus 300, the operation display unit 307, or the ID card reading unit 308, an instruction to output the sheets S stored in the storage portion, the controller 302 identifies the storage portion from which the sheets S are to be output (S501). To identify the storage portion from which the sheets S are to be output, the controller 302 examines a current storage condition of the sheets S in the storage unit 200. The storage condition of the sheet S is information as to whether each of the storage portions 201 to 203 stores the sheet S, information about the job numbers of the sheets S, and information as to whether storing of the sheets S in each of the storage portions has been completed.

To determine whether each of the storage portions 201 to 203 stores the sheet S, the sensors 231 to 233 can be used. In addition, the job numbers of the sheets S stored in the storage portions 201 to 203 are stored in the memory 305. Each time the job is switched, the job numbers are sequentially changed. A job number is a unique number assigned to a job for which printing is instructed. The job number is incremented by one in the order in which printing of the job is instructed. The job number is deleted from the memory 305 if all the sheets of the job are output. The controller 302 determines whether each of the storage portions is full of sheets by determining whether an additional sheet can be stored in the storage portion, that is, the storage portion is currently storing sheets. If the storage portion is empty or the storage portion is currently storing sheets, the controller 302 determines that storing of the sheets is not completed. However, if the storage portion is full or the last sheet S of the job is loaded into the storage portion, the controller 302 determines that storing the sheets is completed. For example, if 15 sheets are printed and stored in the storage unit 200, first 10 sheets are stored in the storage portion 202, and the remaining 5 sheets are stored in the storage portion 201. In such a case, when the storage portion 202 stores 10 sheets, it is determined that the storage portion 202 is full and, thus, storing of the sheets S is completed. If the remaining 5 pages are being stored in the storage portion 201, it is determined that storing of the sheets is not completed. When the remaining 5 sheets have been stored, it is determined that storing of the sheets is completed. According to the present embodiment, the storage portion that is determined to complete storing the sheets by the controller 302 in the above-described manner is considered as a storage portion that is a target of sheet output.

After examining the storage state of the sheets S, the controller 302 outputs the sheets from the storage portions in the ascending or descending order of the job number of the sheet S among the storage portions storing printed sheets S. If the storage portions storing sheets S having the same job number are present, the sheets S are output at the same time. According to the present embodiment, if the sheets S are output in ascending order of the job number, the storage portions storing the sheets S having a smaller job number or the some job number are the target of sheet output. A storage portion storing no sheet S or capable of storing additional sheet S is not considered as the target of sheet output. Note that when the sheet S to be stored is not present and if all the sheets S have been stored, a storage portion that is not full is also selected as the target of sheet output.

If a storage portion that is the target of sheet output is not present, the controller 302 performs the process in S501 again and waits until a storage portion that is the target of sheet output appears (S502). However, if a storage portion that is the target of sheet output is present, the controller 302 sends, to the control unit 304, an instruction to output the sheet S stored in the storage portion that is the target of sheet output so that the sheet moving unit exposes part of the sheets S through the opening 250 (S503). The controller 302 determines whether the exposed sheets S have been removed on the basis of the result of detection made by the sensor 236 obtained via the control unit 304 (S504). The control unit 304 determines whether the sheets S have been removed on the basis of whether the sensor 236 is turned from on to off. If the sheets S are removed, the controller 302 determines whether output of the all sheets S is completed (S505). If it is determined that output of all the sheets S is completed, the processing based on the flowchart is completed. However, if the controller 302 determines that the sheet S to be output still remains, the controller 302 performs the process in S501 again.

Figure 10:
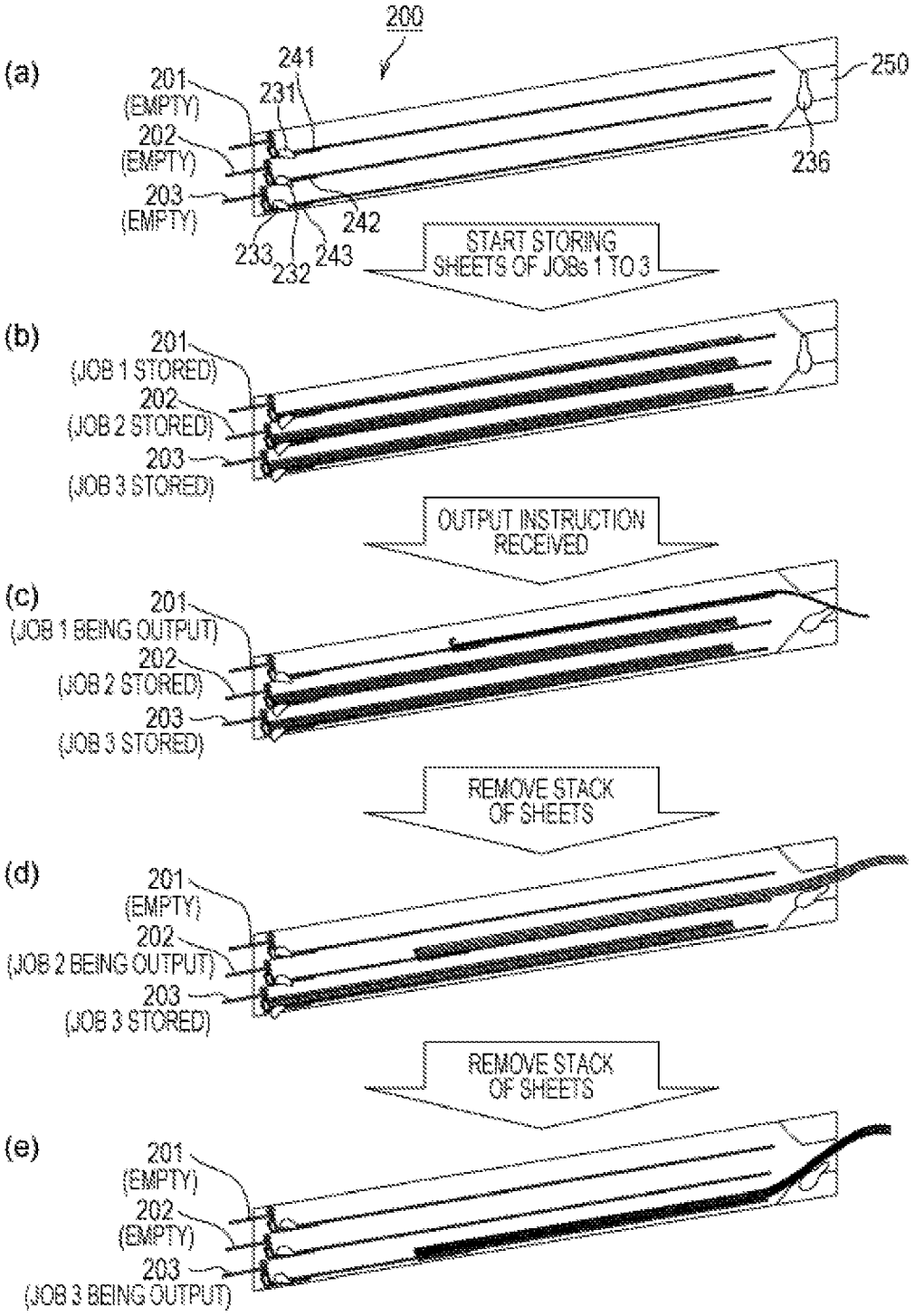
FIG. 10 illustrates a particular example of the first embodiment of the present invention.

A particular example is illustrated in FIG. 10. As illustrated in a section (a) of FIG. 10, the storage unit 200 includes the storage portions 201 to 203, all of which are empty. Each of the storage portions 201 to 203 can store 10 sheets S (i.e., the upper limit of the number of sheets S storable in each of the storage portions 201 to 203 is ten). As illustrated in a section (b) of FIG. 10, the storage portions 201, 202, and 203 convey and store the sheets S having job numbers of 1, 2, and 3, respectively. All of jobs having job numbers of 1, 2, and 3 are submitted for printing by the user A. If the user A instructs output of the sheets S after the sheets S are stored, the controller 302 identifies the storage portion that is the target of sheet output. At that time, all the storage portions 201, 202, and 203 have completed storing the sheet S and can output the sheets S. In this case, the storage portion 201 storing the sheets S having the lowest job number is the target of sheet output. Accordingly, as illustrated in a section (c) of FIG. 10, the sheet moving unit 241 moves from the loading position to the exposed position so that the sheets S stored in the storage portion 201 are exposed outside the image forming apparatus 100 through the opening 250. If the sensor 236 is turned from on to off and, thus, it is detected that the stack of the sheets S is removed, the sheet moving unit 241 moves from the exposed position to the loading position. If the sensor 231 detects that the sheet S is not stored, the storage portion 201 can store a new sheet S. In addition, a screen that notifies the user of information indicating that the sheets S are subsequently output through the opening 250 may be displayed on the operation display unit 307.

Subsequently, the controller 302 identifies a storage portion that is the target of sheet output. The storage portions 202 and 203 store printed sheets S, which can be output. In this case, the storage portion 202 stores the sheet S having the lowest job number. Thus, the storage portion 202 is identified as the target of sheet output. Accordingly, as illustrated in a section (d) of FIG. 10, the sheet moving unit 242 moves the loading position to the exposed position so that the sheets S stored in the storage portion 202 are moved through the opening 250 and are exposed outside the image forming apparatus 100. If the sensor 236 is turned from on to off and, thus, it is detected that the stack of the sheets S is removed, the sheet moving unit 242 moves the exposed position to the loading position. Furthermore, if the sensor 232 detects that no sheet S is stored, the storage portion 202 can store anew sheet S. As illustrated in a section (e) of FIG. 10, the storage portion 203 also outputs the sheets S in a similar manner. Thereafter, the stack of the sheets S are removed. If it is determined that no sheet S is stored in the storage portion 203, the storage portion 203 can store a new sheet S. According to the present embodiment, in response to an output instruction input from the user A, the above-described control is automatically and completely performed. That is, the user A can continuously pick up their sheets through the opening 250. As a result, to pick up the sheets S stored in the storage portions, the user need not input an output instruction for each storage portion and, thus, the usability can be increased.

In addition, in FIG. 10, immediately before the storage unit 200 starts storing the sheets S, all the storage portions are empty. However, if the storage portion 201, for example, stores a sheet S of another user B at that time, the storage portion 201 cannot be used. Accordingly, at that time, only the storage portions 202 and 203 can be used to store the sheets S. In such a case, the above-described control can be applied to the storage portions 202 and 203.

As described above, according to the present embodiment, an image forming apparatus that allows the user to pick up sheets stored in a plurality of storage portions without troublesome operations can be provided.

According to the present embodiment, to select one of the storage portions as a target of sheet output, a storage portion for a job having a small job number has priority. However, the priority need not depend on the job number. For example, a property of the job, such as the number of sheets of the job, may be used to determine the priority.

While the present embodiment has been described with reference to the sheet moving units 241 to 243 each driven by a dedicated actuator, the configuration is not limited thereto. A configuration in which a single actuator selectively drives a plurality of sheet moving units by using a drive power transfer switching unit, such as a clutch (not illustrated), may be employed. In particular, the embodiment is effective for a configuration having only one small actuator that cannot drive the sheet moving units 241 to 243 at the same time. In addition, the embodiment is effective if, for example, the opening 250 is small and, thus, the number of sheets to be exposed outside the apparatus is limited (e.g., if only a plurality of sheets equal in number to the upper limit storable in one storage portion can be exposed outside the apparatus).

Second Embodiment

In the first embodiment, the control is performed when the user inputs a sheet output instruction after all the sheets S are printed and stored. Unlike the first embodiment, according to the present embodiment, control is performed when the user inputs print instructions for a plurality of jobs and, thereafter, inputs a sheet output instruction during the sheets S being stored in a storage portion.

Since the configurations of an image forming apparatus 100 and a storage unit 200 according to the present embodiment and the functional block diagrams of the configurations are the same as those in the first embodiment, descriptions of the configurations and functional block diagrams are not repeated. In addition, a flowchart of control performed when a sheet S is output from the storage unit 200 is similar to that of the first embodiment. Only some of storage conditions of the sheet S defined in S501 of FIG. 9 differ from those in the first embodiment. The storage condition of a sheet S according to the present embodiment is described below.

In S501 of FIG. 9, if the user inputs, to the external apparatus 300, the operation display unit 307, or the ID card reading unit 308, an instruction to output the sheets S stored in the storage portion, the controller 302 identifies the storage portion from which the sheet S is to be output. To identify the storage portion from which the sheet S is to be output, the controller 302 examines a current storage condition of the sheets S in the storage unit 200.

According to the present embodiment, the storage condition of the sheet S is information as to whether each of the storage portions 201 to 203 stores the sheet S, information about the job number of the sheet S, and information as to whether storing of the sheets S in each of the storage portion has been completed. The information as to whether each of the storage portions 201 to 203 stores the sheet S and the information about the job number of the sheet S are the same as those in the first embodiment. The controller 302 determines whether storing of the sheets S in each of the storage portion has been completed. The controller 302 determines that storing of the sheets S of a job in the storage portions has not been completed until printing and storing of the last sheet S of the job are completed. When printing and storing of the last sheet S of the job are completed, the controller 302 determines that storing of the sheets S of a job in the storage portions has been completed. For example, if 15 sheets of a job are printed and are stored in the storage unit 200, first 10 sheets are stored in the storage portion 202, and the remaining 5 sheets are stored in the storage portion 201. In such a case, upon storing 10 sheets, the storage portion 202 becomes full. If the remaining 5 pages (a predetermined number of sheets) are being stored in the storage portion 201, it is determined that the storage portions 201 and 202 do not complete storing the sheets S. Thereafter, when all the remaining 5 sheets are stored in the storage portion 201, it is determined that storing of the sheets S for the job is completed. According to the present embodiment, the storage portion that is determined to complete storing of the sheets S by the controller 302 is defined as a storage portion that is the targets of sheet output.

After examining such a storage state of the sheets S, the controller 302 selects the storage portions having the same job number that is the smallest as the targets of sheet output. The controller 302 do not select an empty storage portion storing no sheet S or capable of storing additional sheet S as the target of sheet output. Note that when the sheet S to be stored is not present and if all the sheets S have been stored, even a storage portion that is not full is also selected as the target of sheet output.

Figure 11:
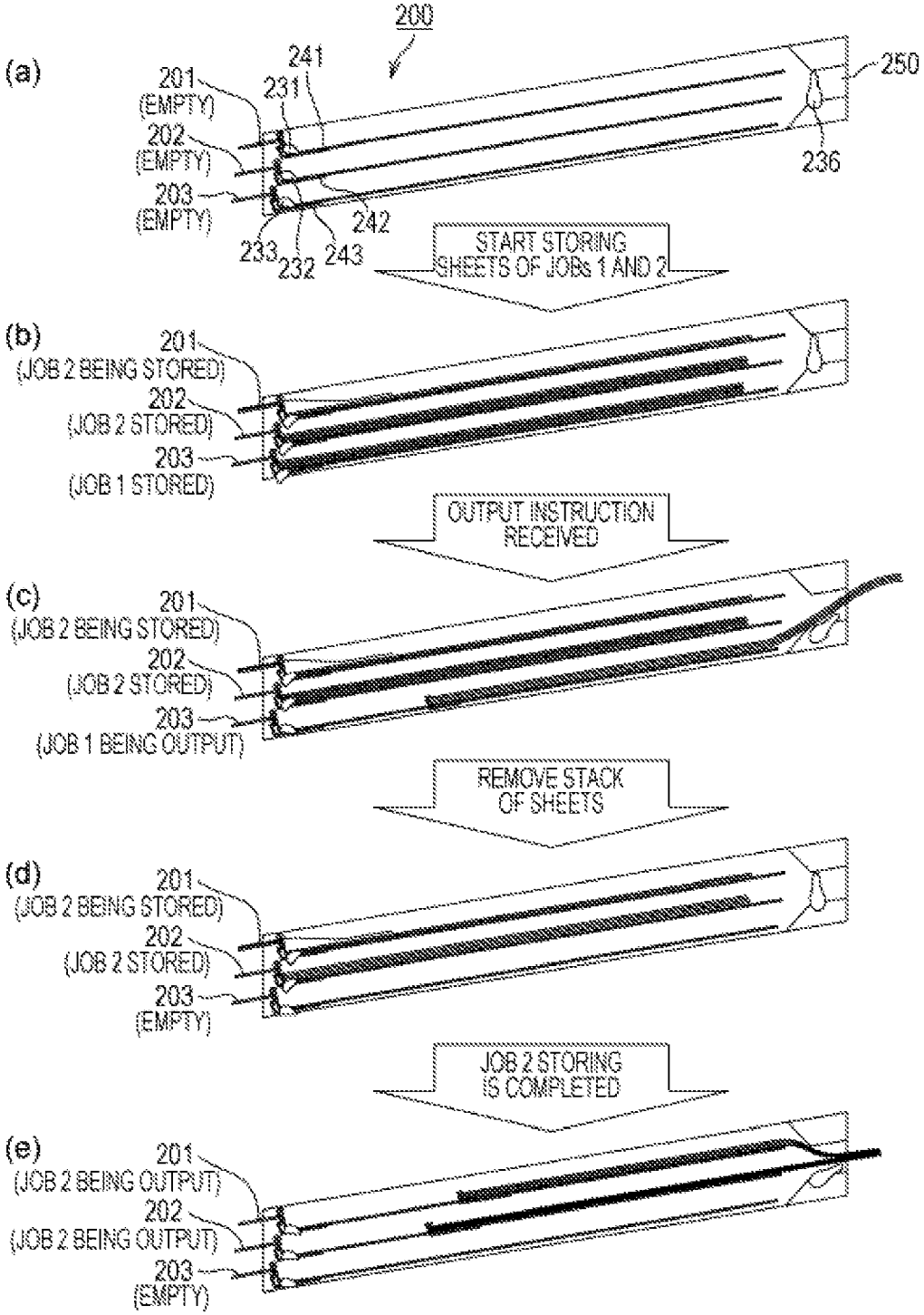
FIG. 11 illustrates a particular example of a second embodiment of the present invention.

A particular example of the present embodiment is illustrated in FIG. 11. As illustrated in a section (a) of FIG. 11, the storage unit 200 includes three storage portions 201 to 203, all of which are empty. Each of the storage portions 201 to 203 can store 10 sheets S (i.e., the upper limit of the number of sheets S storable in each of the storage portions 201 to 203 is ten). Accordingly, as illustrated in the section (a) of FIG. 11, to store 15 sheets in total, two storage portions are required. As illustrated in a section (b) of FIG. 11, 5 sheets S having a job number of "1" are stored in the storage portion 203. In addition, 10 sheets S having a job number of "2" are stored in the storage portion 202. Furthermore, the remaining sheets S having a job number of "2" are currently being conveyed into the storage portion 201. If, at that time, the user inputs an output instruction, the controller 302 performs a process to determine a storage portion that is the target of sheet output. Since the storage portion 203 has completed storing the sheets S for the job, the storage portion 203 is selected as the target of sheet output. Thus, as illustrated in a section (c) of FIG. 11, the sheet moving unit 243 moves from the loading position to the exposed position so that the sheets S stored in the storage portion 203 are exposed outside the image forming apparatus 100 through the opening 250. At that time, the conveyance unit 105 continuously conveys the sheets S into the storage portion 201. If the sensor 236 is turned from on to off and, thus, it is detected that the stack of the sheets S is removed, the sheet moving unit 243 moves from the exposed position to the loading position. Thereafter, if the sensor 233 detects that the sheet S is not stored, the storage portion 203 can store a new sheet S.

A section (d) of FIG. 11 illustrates the storage portions 201 to 203 when after the sheets S in the storage portion 203 are output, sheet output is stopped until storing of the sheets S having a job number of "2" is completed. At that time, a screen that notifies the user that an unprinted sheet S still remains may be displayed on, for example, the operation display unit 307. Since the sheets S having a job number of "2" are being stored, the storage portions 201 and 202 are not selected as the targets of sheet output. After storing of the sheets S having a job number of "2" is completed, the storage portions 201 and 202 are selected as the targets of sheet output. Thus, as illustrated in a section (e) of FIG. 11, each of the sheet moving units 241 and 242 moves from the loading position to the exposed position so that the sheets S stored in the storage portions 201 and 202 are put together and are exposed outside the image forming apparatus 100 through the opening 250. If the sensor 236 is turned from on to off and, thus, it is detected that the stacks of the sheets S are removed, each of the sheet moving units 241 and 242 moves from the exposed position to the loading position. Thereafter, if each of the sensors 231 and 232 detects that the sheet S is not stored, each of the storage portions 201 and 202 can store a new sheet S.

In addition, when the sheets S stored in the storage portion 201 and the storage portion 202 are output, the storage portion 203 is empty and, thus, the storage portion 203 can store a new sheet S. Accordingly, if the controller 302 receives a print instruction for another job, the storage portion 203 may store a sheet S.

Furthermore, when the number of sheets S of a job having a job number of "2" is greater than or equal to 20 and, thus, three storage portions are required to store all the sheets S and if the storage portion 201 becomes full, the storage portion 203 that is empty may store the sheets S.

As described above, according to the present embodiment, an image forming apparatus that allows the user to pick up sheets stored in a plurality of storage portions without troublesome operations can be provided. In addition, if the user inputs an output instruction of the sheets S when the sheets S are being stored in a storage portion, the user can pick up the sheets S that are printed and stored in the storage unit 200 at the earliest moment. Furthermore, by selecting the storage portions that have stored the sheets S for a job as the target of sheet output, the user can pick up the sheets S for the job.

Still furthermore, according to the present embodiment, the controller selects, as the target of sheet output, the storage portion determined as a storage portion that completes storing the sheets for a job. However, like the first embodiment, the controller may select a storage portion that is the target of sheet output on the basis of whether the storage portion completes storing sheets. That is, in the section (d) of FIG. 11, output of sheets stored in the storage portion 202 is stopped until storing of sheets of a job having a job number of "2" in the storage portion 201 is completed. However, the sheet stored in the storage portion 202 may be output before the sheets of a job having a job number of "2" is completed. In this manner, the user can pick up the sheets from the storage unit 200 at the earliest moment.

Third Embodiment

In the first and second embodiments, if a user inputs an output instruction of the sheets S stored in a storage portion, the controller 302 selects outputtable sheets S and Outputs the sheets S. At that time, the order in which the sheets S are output are not determined. If the user inputs an output instruction to the external apparatus 300 and, thereafter, picks up the sheets S exposed outside the image forming apparatus 100 through the opening 250, there is a risk that the sheets S exposed outside the image forming apparatus 100 may be picked up by another user before the user picks up the sheets S. Accordingly, when security levels are assigned to jobs and if sheets S having a higher security level are exposed before sheets S having a lower security level are exposed, another user can easily pick up the wrong sheets. As a result, a serious security problem may arise.

Figure 12:
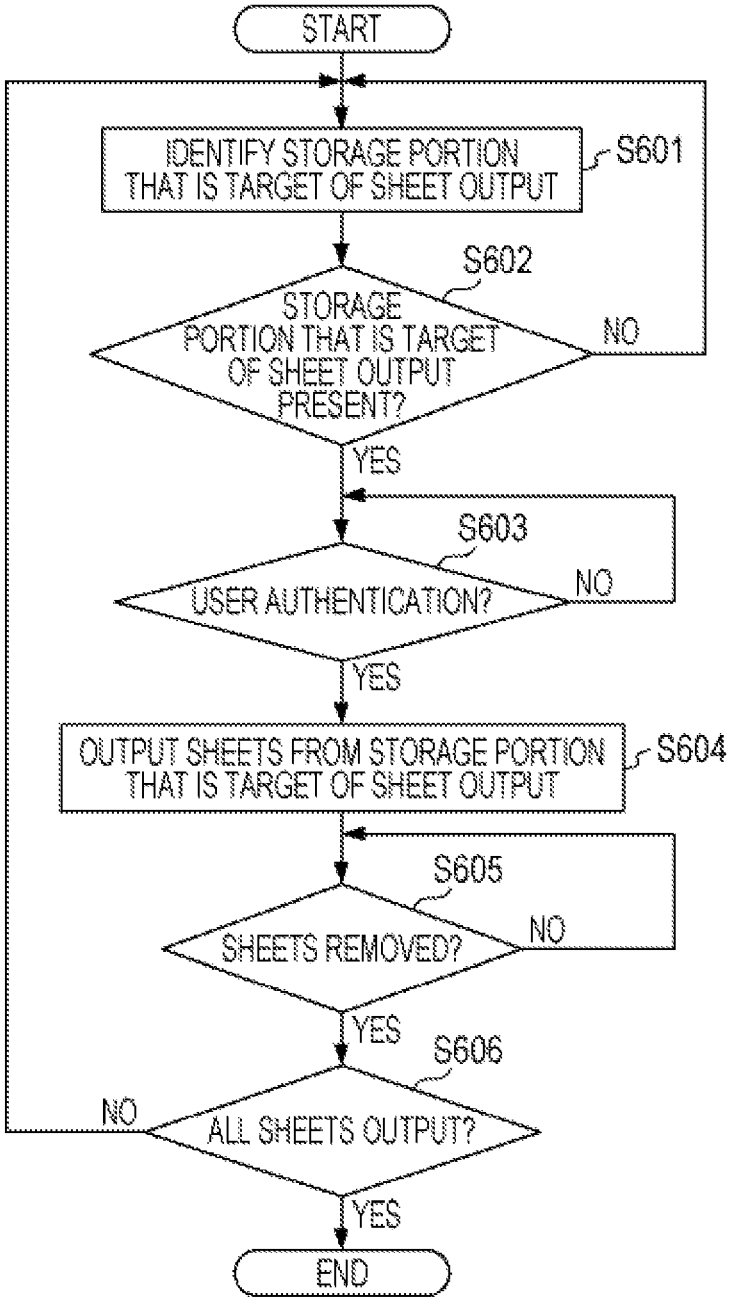
FIG. 12 is a flowchart of the operation according to a third embodiment of the present invention.

According to the present embodiment, when a sheet output instruction is input, the order in which sheets in storage portions are output is controlled in accordance with the security levels of the sheets. The sheets having the lowest security level is output first. In addition, when a user picks up the sheet having a security level higher than or equal to a predetermined security level, user authentication is performed. In this manner, sheets having a high security level are not picked up by a wrong user, and sheets having a low security level can be promptly output. The flowchart according to the present embodiment is illustrated in FIG. 12. Note that the control based on the flowchart is performed by, for example, the controller 302 illustrated in FIG. 4 on the basis of a program stored in the memory 305. Since the configurations of an image forming apparatus 100 and a storage unit 200 according to the present embodiment and the functional block diagrams of the configurations are the same as those in the first embodiment, descriptions of the configurations and functional block diagrams are not repeated.

The flowchart illustrated in FIG. 12 relates to control performed mainly when the sheets S are output from the storage unit 200. If the user inputs, to the external apparatus 300, an instruction to output the sheets S stored in a storage portion, the controller 302 identifies the storage portion from which the sheet S is to be output (S601). To identify the storage portion from which the sheets S are to be output, the controller 302 examines a current storage condition of the sheets S in the storage unit 200. The storage condition of the sheet S is information as to whether each of the storage portions 201 to 203 stores a sheet S, information about the job number of the sheet S, information as to whether storing of the sheets S for a job has been completed, and a security level. The information as to whether each of the storage portions 201 to 203 stores a sheet S, the information about the job number of the sheet S, and the information as to whether storing the sheets S for a job has been completed are the same as those of the second embodiment. The security level is assigned to a job or a sheet S. The number of security levels is determined by the user. According to the present embodiment, one of five security levels is assigned to a job. The level 1 of the security level is the lowest, and the level 5 is the highest. The security level stored in the memory 305 is deleted from the memory 305 when the sheets S corresponding to a job to which the security level is assigned are output.

After examining such a storage condition of the sheet S, the controller 302 outputs the sheets S from a plurality of storage portions in order from the lowest security level to the highest priority level. The controller 302 selects, as the target of sheet output, the storage portion storing the sheets S of a job having a low security level and storage portions storing the sheets S of jobs having the same security level. According to the present embodiment, to select the target of sheet output, outputting of the sheets S in order of increasing security level has a priority over outputting of the sheets S of a job that has been stored. Accordingly, if the security level of a job A having sheets S that have been stored is higher than the security level of a job B having sheets that are currently being stored, the sheets S of the job A that have been stored are not output even when an output instruction of the sheets S is input. The controller 302 waits until storing of sheets S of the job B having a lower security level is completed. After storing and outputting of the sheets of the job B are completed, the controller 302 outputs the sheets S of the job A. The controller 302 does not select an empty storage portion storing no sheet S or a storage portion that can additionally store a sheet S as the target of sheet output. Note that when the sheet S to be stored is not present and if all the sheets S have been stored, a storage portion that is not full is also selected as the target of sheet output.

If a storage portion that is the target of sheet output is not present, the controller 302 performs the process in S601 again and waits until a storage portion that is the target of sheet output appears (S602). However, if a storage portion that is the target of sheet output is present, the controller 302 instructs the operation display unit 307 to display a message indicating that user authentication is required. Thereafter, user authentication is performed (S603).

The user needs to be identified as the user who input the output instruction to the operation display unit 307. By inputting a predetermined password to the operation display unit 307, the user can pass the user authentication. Alternatively, by causing the ID card reading unit 308 to read the ID card of the user, the user can pass the user authentication. According to the present embodiment, by inputting a predetermined password, the user passes the user authentication. If the security level is higher than or equal to a predetermined security level, the sheets S are not output even when the user inputs an output instruction to the external apparatus 300. Thereafter, if the user inputs the password to the operation display unit 307, the sheets S are output. However, if the security level is lower than the predetermined security level, the sheets S stored in the storage portion selected as the target of sheet output are output when an output instruction is input to the external apparatus 300 (that is, S603 is skipped). In addition, it is estimated that immediately after the security authentication is performed, the user is located at a position at which the user can pick up the sheet S. Thus, the subsequent security authentication is skipped.

If the user authentication to guarantee that the user is a user who input the output instruction is unsuccessful, the controller 302 performs the process in S603 again. However, the user authentication is successful, the controller 302 sends, to the control unit 304, an instruction to output the sheets S stored in the storage portion that is the target of sheet output so that part of the sheets S is exposed outside the image forming apparatus 100 through the opening 250 (S604). The controller 302 determines whether the sheets S are removed on the basis of the result of detection performed by the sensor 236 and obtained via the control unit 304 (S605). The control unit 304 determines that the sheets S are removed if the sensor 236 is turned from on to off. If the sheets S are removed, the controller 302 determines whether all the sheets S have been output (S606). If the controller 302 determines that all the sheets S have been output, the processing of the flowchart is completed. However, if the controller 302 determines that a sheet S to be output still remains, the controller 302 performs the process in S601 again.

Figure 13:
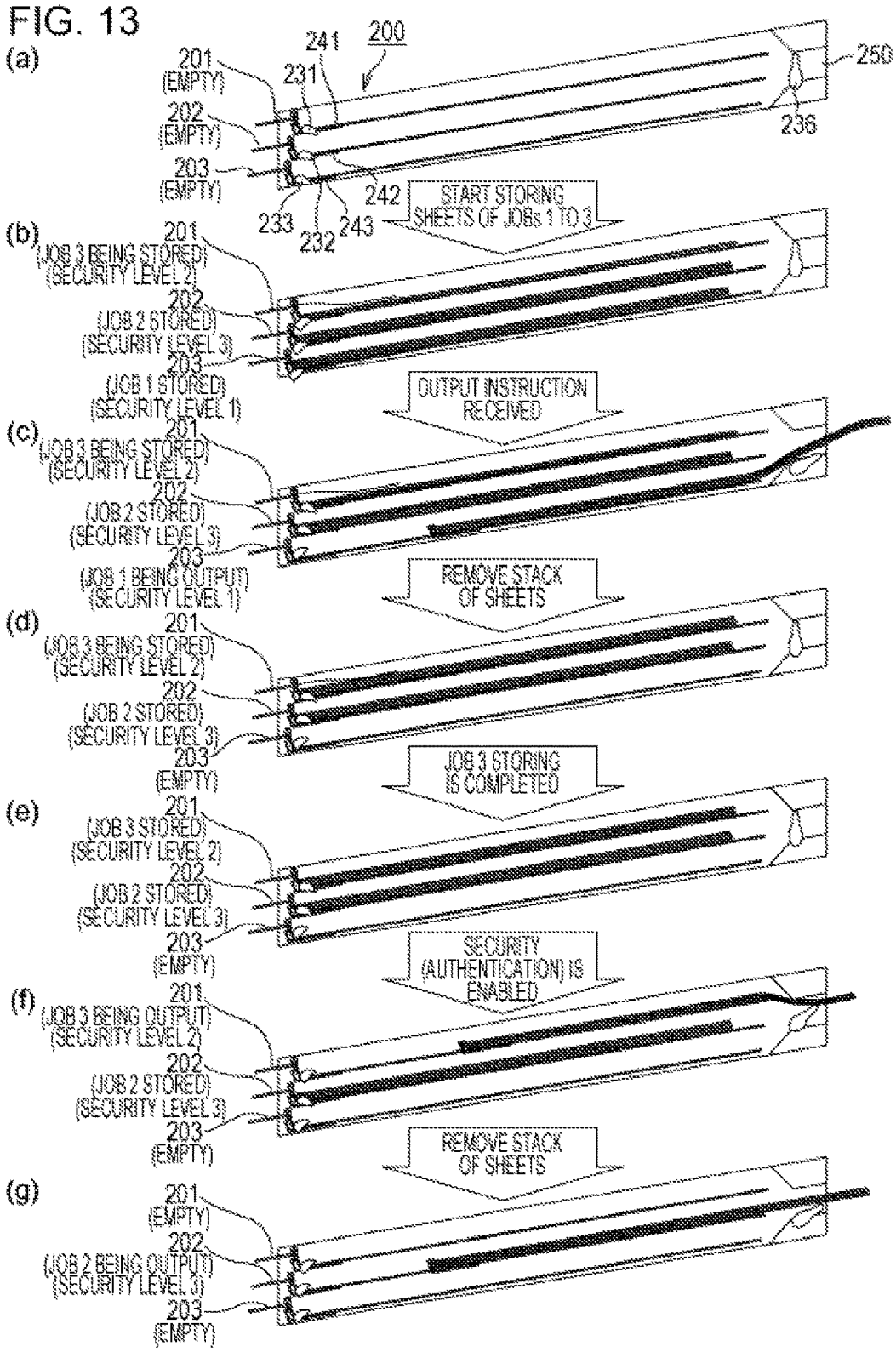
FIG. 13 illustrates a particular example of a third embodiment of the present invention.

A particular example of the present embodiment is illustrated in FIG. 13. In FIG. 13, the jobs having the sheets S stored in the storage portions 201 to 203 are jobs of the same user. As illustrated in a section (a) of FIG. 13, the storage unit 200 includes three storage portions 201 to 203, all of which are empty. Each of the storage portions 201 to 203 can store 10 sheets S (i.e., the upper limit of the number of sheets S storable in each of the storage portions 201 to 203 is ten). As illustrated in a section (b) of FIG. 13, ten sheets S having a job number of "1" are stored in the storage portion 202, ten sheets S having a job number of "2" are stored in the storage portion 202. In addition, sheets S having a job number of "3" are being stored in the storage portion 201. The security level of the job having a job number of "1" is "1". The security level of the job having a job number of "2" is "3". The security level of the job having a job number of "3" is "2". According to the present embodiment, a security level is assigned to each of the job numbers.

At that time, if the user inputs an output instruction, the controller 302 identifies e storage portion that is the target of sheet output. Since the storage portion 203 has completed storing the sheets S of the job having a job number of "1" and the security level of the job is the lowest among the three jobs, the storage portion 203 is selected as the target of sheet output. Accordingly, as illustrated in a section (c) of FIG. 13, the sheet moving unit 243 moves from the loading position to the exposed position so that the sheets S stored in the storage portion 203 are exposed outside the image forming apparatus 100 through the opening 250. At that time, the conveyance unit 105 continuously conveys the sheets S into the storage portion 201. If the sensor 236 is turned from on to off and, thus, it is detected that the stack of the sheets S is removed, the sheet moving unit 243 moves from the exposed position to the loading position. Thereafter, if the sensor 233 detects that the sheet S is not stored, the storage portion 203 can store a new sheet S.

The job having a job number of "3" has the second lowest security level next to the job having a job number of "1". Accordingly, the storage portion 201 is selected as the target of sheet output next. However, at that time, the sheets S of the job having a job number of "3" are being stored. According to the present embodiment, to select the target of sheet output, outputting of the sheets S in order of increasing security level has a priority over outputting of the sheets S of a job that has been stored. Accordingly, the sheets S of the job having a job number of "2" that have been stored are not output first, and the storage portion 202 is not selected as the target of sheet output until storing of the sheets S of the job having a job number of "3" is completed. As illustrated in a section (d) FIG. 13, the controller 302 waits until storing of the sheets S of the job having a job number of "3" is completed. At that time, a screen notifying the user that the sheets S are being printed may be displayed on the operation display unit 307.

As illustrated in a section (e) of FIG. 13, when storing of the sheet S of the job having a job number of "3" is completed, the storage portion 201 is selected as the target of sheet output. According to the present embodiment, user authentication is required for jobs having a security level of 2 or higher. Since the job having a job number of "3" has a security level higher than or equal to 2, the controller 302 notifies the user of that information via, for example, the operation display unit 307. If the user authentication is performed successfully, the sheet moving unit 241 moves from the loading position to the exposed position, as illustrated in a section (f) of FIG. 13, so that the sheets S stored in the storage portion 201 are exposed outside the image forming apparatus 100 through the opening 250. If the sensor 236 is turned from on to off and, thus, it is detected that the stack of the sheets S is removed, the sheet moving unit 241 moves from the exposed position to the loading position. Thereafter, if the sensor 231 detects that the sheet S is not stored, the storage portion 201 can store a new sheet S.

When output of the sheet S of the job having a job number of "3" is completed, the storage portion 202 is selected as the target of sheet output. At that time, although the job having a job number of "3" has a security level higher than or equal to 2, user authentication is skipped since the user authentication has already been performed. Thereafter, as illustrated in a section (g) FIG. 13, the sheet moving unit 242 moves from the loading position to the exposed position so that the sheets S stored in the storage portion 202 are exposed outside the image forming apparatus 100 through the opening 250. If the sensor 236 is turned from on to off and, thus, it is detected that the stack of the sheets S is removed, the sheet moving unit 242 moves from the exposed position to the loading position. Thereafter, if the sensor 232 detects that the sheet S is not stored, the storage portion 202 can store a new sheet S.

As described above, according to the present embodiment, an image forming apparatus that allows the user to pick up sheets stored in a plurality of storage portions without troublesome operations can be provided. In addition, by outputting sheets of a job having the lowest security level first, a security problem caused by a wrong user picking up the sheets can be remedied.

In addition, if the user wants to cancel outputting the sheet, the user inputs an output cancel instruction to the external apparatus 300 or the operation display unit 307. Thus, the controller 302 executes a cancel program loaded into the memory 305 and cancel the output process.

In addition, while the above-described embodiments have been described with reference to five security levels, the number of the security levels is not limited to five. Any number of security levels may be employed.

In addition, while the above-described embodiments have been described with reference to the security level assigned to a job, the security level may be assigned to a sheet S.

In addition, while the above-described embodiments have been described with reference to an output instruction input to the external apparatus 300, the above-described embodiments may be applied even when the sheet output instruction is input to the operation display unit 307 or the ID card reading unit 308.

In addition, while the above-described embodiments have been described with reference to the processing in which after security authentication is performed, the subsequent security authentication is skipped since it is estimated that the user is located so as to immediately pick up the sheets, the processing is not limited thereto. That is, each time the target of sheet output is selected, security authentication may be performed.

In addition, in the above-described embodiments, if the security level of the job A whose sheets have been stored is higher than the security level of the job B whose sheets are being stored, the stored sheets of the user A are not output even when the output instruction is input. Thereafter, the controller 302 waits until the storing of the sheets of the job B having a priority lower than the priority of the job A is completed. This is because the security level has a priority over completion of storing the sheets of a job. However, the processing is not limited thereto. Completion of storing the sheets of a job may have a priority over the security level. Thus, the stored sheets of the job A may be output first when the output instruction is output.

In the above-described embodiments, the upper limit of the number of sheets storable in the storage portion is fixed to 10, which is stored in the memory 305. However, the upper limit may be variable in accordance with the thickness of the sheet S. An example of a sensor that detects the thickness of the sheet S is a sensor that emits light to the sheet S and detects the intensity of the transmitted light. Alternatively, to obtain the thickness information about the sheet S, a sensor that detects the basis weight (the weight per square meter ($g/m^2$)) can be employed. An example of a sensor that detects the basis weight is an ultrasonic sensor. Ultrasonic sensors emit ultrasonic waves to the sheet S and receive the attenuated ultrasonic waves that has transmitted the sheet S. In this manner, the ultrasonic sensors can detect the basis weight. Such a sensor may be disposed in a conveyance path of the sheet S, and the upper limit of the number of sheets storable in the storage portion may be dynamically varied. Alternatively, the information about the thickness or the basis weight of the sheet S can be obtained from the type of sheet specified in a print instruction input by the user (e.g., thick paper, a plain paper, or a thin paper).

In addition, in the above-described embodiments, the sheets of a plurality of users can be continuously exposed outside the image forming apparatus 100 through the opening 250. For example, the controller 302 identifies the user on the basis of the password input to the operation display unit 307 or the ID information obtained by the ID card reading unit 308. Thereafter, the controller 302 may expose the sheet of another user who belongs to the same group (the same section or team as the user.

In addition, in the above-described embodiments, the sheet moving unit of each of the storage portions has a dedicated actuator. Thus, by simultaneously driving the actuators, the sheets stored in the plurality of storage portions can be put together and are exposed. In contrast, by providing a number of actuators that is less than the number of storage portion and a drive power transfer switching unit, such as a clutch (not illustrated), a single actuator may selectively move the plurality of sheet moving units.

In addition, while the above-described embodiments have been described with reference to the memory 305 included in the controller 302, the memory 305 may be included in the engine control unit 303 or the control unit 304. Alternatively, the memory 305 may be independently disposed in the control unit 301.

In addition, while the above-described embodiments have been described with reference to the engine control unit 303 and the control unit 304 separately disposed from each other, the engine control unit 303 and the control unit 304 may be integrated into one body. In such a case, the engine control unit 303 can control the conveyance unit 105 and the storage unit 200.

In addition, while the above-described embodiments have been described with reference to a structure in which sheet conveyance paths are merged on the downstream side of each of the storage portions and only one opening is provided, a plurality of openings may be provided. At that time, sheets stored in the storage portions may be moved through different openings and be exposed outside the image forming apparatus 100.

In addition, while the above-described embodiments have been described with reference to the configuration including three storage portions, the number of the storage portions is not limited to three. The number of the storage portions can be determined in accordance with the environment in which the image forming apparatus 100 is used, the number of users that use the image forming apparatus 100, or the specification of the performance of the image forming apparatus 100.

In addition, while the above-described embodiments have been described with reference to the configuration in which the storage unit 200 is integrated into the image forming apparatus 100, the storage unit 200 may be configured so as to be attachable to the image forming apparatus 100. In such a case, a control unit provided in the image forming apparatus 100 may control the storage unit 200. Alternatively, an independent control unit may be provided in the storage unit 200 so as to communicate a control unit provided in the image forming apparatus 100. Thus, the control unit may control the operation.

In addition, while the above-described embodiments have been described with reference to a laser beam printer, the image forming apparatus of the present invention is not limited thereto. The image forming apparatus may be other types of printer, such as an inkjet printer, or a copying machine.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An image forming apparatus comprising:

an apparatus body having an opening formed therein;

an image forming unit configured to form an image on a sheet;

a plurality of storage portions configured to store, inside the apparatus body, a sheet having an image formed thereon by the image forming unit;

a sheet moving unit configured to move the sheet stored in each of the plurality of storage portions and to stop the sheet in an exposure state where a part of the sheet is exposed outside the apparatus body through the opening;

a control unit configured to control the sheet moving unit; and a sensing unit configured to sense a sheet that is in the exposure state, wherein the control unit controls the sheet moving unit to move a first sheet stored in a first storage portion and to stop the first sheet in the exposure state, and wherein, in a case where the sensing unit enters a state in which the first sheet is not sensed by the sensing unit from a state in which the first sheet is sensed by the sensing unit, the control unit controls the sheet moving unit to move a second sheet stored in a second storage portion, other than the first storage portion, and to stop the second sheet in the exposure state where a part of the second sheet is exposed outside the apparatus body through the opening through which the first sheet is exposed.

2. The image forming apparatus according to claim 1, further comprising a conveyance unit configured to convey a sheet having an image formed thereon by the image forming unit to any one of the plurality of storage portions, wherein a sheet having an image formed thereon in response to a first image forming instruction input by a user is conveyed to the first storage portion by the conveyance unit, wherein a sheet having an image formed thereon in response to a second image forming instruction input by the user who inputs the first image forming instruction is conveyed to the second storage portion by the conveyance unit, wherein, upon receiving information about the user who inputs the first image forming instruction and the second image forming instruction, the control unit controls the sheet moving unit to move the first sheet and to stop the first sheet in the exposure state, and wherein, in a case where the sensing unit enters a state in which the first sheet is not sensed by the sensing unit from a state in which the first sheet is sensed by the sensing unit, the control unit controls the sheet moving unit to move the second sheet and to stop the second sheet in the exposure state.

3. The image forming apparatus according to claim 1, further comprising conveyance unit configured to convey a sheet having an image formed thereon by the image forming unit to any one of the plurality of storage portions, wherein sheets, each having an image formed thereon in response to an image forming instruction input by a user, are conveyed to the first storage portion and the second storage portion by the conveyance unit, wherein, upon receiving information about the user who inputs the image forming instruction, the control unit controls the sheet moving unit to move the first sheet and to stop the first sheet in the exposure state, and wherein, in a case where the sensing unit enters a state in which the first sheet is not sensed by the sensing unit from a state in which the first sheet is sensed by the sensing unit, the control unit controls the sheet moving unit to move the second sheet and to stop the second sheet in the exposure state.

4. The image forming apparatus according to claim 1, further comprising a conveyance unit configured to convey a sheet having an image formed thereon by the image forming unit to any one of the plurality of storage portions, wherein sheets, each having an image formed thereon in response to an image forming instruction input by a user, are conveyed to the first storage portion and the second storage portion by the conveyance unit, wherein, in a case where information about the user who inputs the image forming instruction is received when the conveyance unit has conveyed the first sheet to the first storage portion and has not conveyed the second sheet to the second storage portion, the control unit controls the sheet moving unit to move the first sheet and to stop the first sheet in the exposure state, and wherein, in a case where the sensing unit enters a state in which the first sheet is not sensed by the sensing unit from a state in which the first sheet is sensed and the conveyance unit has conveyed the second sheet to the second storage portion, the control unit controls the sheet moving unit to move the second sheet and to stop the second sheet in the exposure state.

5. The image forming apparatus according to claim 1, further comprising a memory unit configured to store information about a sheet stored in the storage portion, wherein, based on the information stored in the memory unit, the control unit selects the first storage portion which stores the first sheet which is to be moved by the sheet moving unit and selects the second storage portion which stores the second sheet which is to be moved by the sheet moving unit next to the first sheet.

6. The image forming apparatus according to claim 5, wherein the memory unit stores order in which sheets having an image formed thereon in response to an instruction from a user are stored in the plurality of storage portions, and wherein, based on the order, the control unit selects the first storage portion and the second storage portion.

7. The image forming apparatus according to claim 5, wherein the memory unit stores the number of sheets that have an image formed thereon in response to an instruction from a user and that are stored in each of the plurality of storage portions, and wherein, based on the number of sheets, the control unit selects the first storage portion and the second storage portion.

8. The image forming apparatus according to claim 5, wherein the memory unit stores a security level of sheets that have an image formed thereon in response to an instruction from a user and that are stored in each of the plurality of storage portions, and wherein, based on the security level, the control unit selects the first storage portion and the second storage portion.

9. The image forming apparatus according to claim 1, wherein, in response to an output instruction, the control unit controls the sheet moving unit to move the first sheet stored in the first storage portion and to stop the first sheet in the exposure state, and wherein, in a case where the sensing unit enters the state in which the first sheet is not sensed by the sensing unit from the state in which the first sheet is sensed by the sensing unit, even in a case where the control unit does not receive any further output instruction, the control unit controls the sheet moving unit to move the second sheet stored in the second storage portion and to stop the second sheet in the exposure state.

* * * * *